US011617479B2

(12) United States Patent
Hagleitner

(10) Patent No.: US 11,617,479 B2
(45) Date of Patent: Apr. 4, 2023

(54) REFILL FOR A DISPENSER, BEARING UNIT AND DISPENSER

(71) Applicant: Hans Georg Hagleitner, Zell Am See (AT)

(72) Inventor: Hans Georg Hagleitner, Zell Am See (AT)

( * ) Notice: Subject to any disclaimer, the term of this patent is extended or adjusted under 35 U.S.C. 154(b) by 173 days.

(21) Appl. No.: 16/907,501

(22) Filed: Jun. 22, 2020

(65) Prior Publication Data

US 2020/0315409 A1 Oct. 8, 2020

Related U.S. Application Data

(63) Continuation of application No. PCT/AT2018/060275, filed on Nov. 23, 2018.

(30) Foreign Application Priority Data

Dec. 22, 2017 (AT) ..... A 51080/2017

(51) Int. Cl.
*A47K 10/38* (2006.01)
*B65H 75/08* (2006.01)
*B65H 75/18* (2006.01)

(52) U.S. Cl.
CPC ..... *A47K 10/3845* (2013.01); *B65H 75/08* (2013.01); *B65H 75/185* (2013.01); *B65H 2301/41369* (2013.01)

(58) Field of Classification Search
None
See application file for complete search history.

(56) References Cited

U.S. PATENT DOCUMENTS 5,310,129 A 5/1994 Whittington
5,322,234 A * 6/1994 Robert ..... B65H 75/185 242/596.7
5,669,576 A * 9/1997 Moody ..... B65H 75/22 242/560.3
5,755,397 A * 5/1998 Freese ..... A47K 10/38 242/423.1
5,758,843 A * 6/1998 Ongaro ..... A47K 10/3836 242/563.2

(Continued)

FOREIGN PATENT DOCUMENTS

CL 2013001234 A1 11/2013
CL 2016001071 A1 10/2016

(Continued)

OTHER PUBLICATIONS

Cardboard Cores "Paper-tubes", article (Jun. 2, 2015) Core Manufactures/ Cardboard Core Suppliers, retrieved from https://www.paper-tubes.net (Feb. 23, 2022).

*Primary Examiner* — William A. Rivera
(74) *Attorney, Agent, or Firm* — Laurence A. Greenberg; Werner H. Stemer; Ralph E. Locher

(57) ABSTRACT

Refill for a dispenser, with a material web wound to form a roll and at least one substantially axially adjustable bearing journal. The at least one substantially axially adjustable bearing journal is adjustable substantially axially outwards away from the roll starting from a defined inner end position in which it protrudes axially beyond the roll. A bearing unit for such a refill, and a dispenser for housing the refill and dispensing the material web are also provided.

35 Claims, 22 Drawing Sheets

(56) References Cited

U.S. PATENT DOCUMENTS

| | | | | |
|---|---|---|---|---|
| 6,409,120 | B1 * | 6/2002 | Tramontina | A47K 10/38 242/596.4 |
| 6,439,502 | B1 | 8/2002 | Gemmell et al. | |
| 7,828,240 | B2 | 11/2010 | Hagleitner | |
| 9,675,217 | B2 | 6/2017 | Hagleitner | |
| 9,756,993 | B2 | 9/2017 | Hagleitner | |
| 10,105,020 | B2 | 10/2018 | Carper et al. | |
| 10,383,487 | B2 | 8/2019 | Hagleitner | |
| 10,710,832 | B2 * | 7/2020 | Rozek | B65H 75/185 |
| 10,765,273 | B1 * | 9/2020 | Work | A47K 10/405 |
| 10,952,570 | B2 * | 3/2021 | Robertson | A47K 10/3687 |
| 2010/0187351 | A1 * | 7/2010 | Billman | B65H 75/185 242/599 |
| 2010/0236956 | A1 * | 9/2010 | Kling | A47K 10/38 53/469 |
| 2011/0042503 | A1 | 2/2011 | Hagleitner | |
| 2012/0097790 | A1 * | 4/2012 | Wilkins | B65H 75/08 206/0.5 |
| 2012/0104142 | A1 * | 5/2012 | Phelps | A47K 10/40 242/596.4 |
| 2012/0104144 | A1 | 5/2012 | Formon et al. | |
| 2012/0111987 | A1 | 5/2012 | Phelps | |
| 2017/0071421 | A1 | 3/2017 | Hagleitner | |
| 2020/0008630 | A1 * | 1/2020 | Robertson | B65H 16/005 |

FOREIGN PATENT DOCUMENTS

| | | | |
|---|---|---|---|
| CN | 107032196 | A | 8/2017 |
| CO | 7141447 | A2 | 12/2014 |
| EP | 1927308 | B1 | 3/2010 |
| GB | 2362375 | A | 11/2001 |
| JP | S5025863 | B1 | 8/1975 |
| JP | S5331644 | U | 3/1978 |
| WO | 9912460 | A1 | 3/1999 |
| WO | 2007111561 | A1 | 10/2007 |
| WO | 2013123535 | A2 | 8/2013 |
| WO | 2013123536 | A2 | 8/2013 |
| WO | 2015176091 | A1 | 11/2015 |

* cited by examiner

REFILL FOR A DISPENSER, BEARING UNIT AND DISPENSER

CROSS-REFERENCE TO RELATED APPLICATION

This application is a continuation, under 35 U.S.C. § 120, of copending international application No. PCT/AT2018/060275, filed Nov. 23, 2018, which designated the United States; this application also claims the priority, under 35 U.S.C. § 119, of Austrian patent application No. A 51080/2017, filed Dec. 22, 2017; the prior applications are herewith incorporated by reference in their entirety.

BACKGROUND OF THE INVENTION

Field of the Invention

The invention relates to a refill for a dispenser, in particular a sanitary dispenser for dispensing toilet paper or paper towels. The invention also relates to a bearing unit for such a refill, and lastly also to a dispenser for portions of a refill having a material web wound to form a roll.

In the application the following terms are used substantially as follows, without being limited thereto:

Dispenser: The dispenser is a device which can preferably be mounted on a wall, with a housing for holding refills having a material web wound to form a roll. Inside, the dispenser typically has a guide track leading from an upper insertion position to a lower dispensing position. Bearing journals protruding from the refill are guided in this guide track. When in the dispensing position, the refill can rotate in order to unwind material and dispense portions thereof out of the dispenser.

Refill: By refill is meant a material web, in particular made of paper, wound to form a roll. From both sides of the refill, bearing journals protrude, via which the refill is rotatably mounted.

Bearing journal: The bearing journals protruding from the refill are used to rotatably mount the refill in the dispenser.

Axial support: The axial support on the one hand is connected to the material web wound to form a roll and on the other hand carries the bearing journals protruding beyond the roll.

(1) There are at least three types of axial support:

(2) One axial support which extends substantially through the roll of the refill. Such an axial support is referred to as a support bar.

(3) Two separate axial supports which are inserted from the side into a roll—preferably provided with a hollow cardboard core. Such axial supports are referred to as end caps.

(4) Two separate axial supports which are preferably pushed from the side into rolls wound in a coreless manner in the axial region. Such axial supports are referred to as retaining tips.

Bearing unit: A bearing unit denotes a module consisting of the axial support and bearing journals which can be inserted into a refill in its entirety.

Dispensers for material webs wound to form rolls (refills) are known in a variety of designs. The material webs are predominantly paper, in particular toilet or tissue paper, kitchen paper, etc., but also plastics films or metal foils. Often, the dispensers have opposing walls in which guide tracks are provided from a filling point at least to a dispensing position, and optionally further into a collection chamber for empty bearing units holding the rolls.

A new refill is thus inserted with the two bearing journals of a bearing unit into the two guide tracks and then generally slides downwards into the dispensing position under the effect of gravity. If the bearing journals are formed on the ends of a support bar, then once the roll has been used up the empty support bar falls further downwards into the collection chamber, and can be removed there.

If the refills are always to be inserted in the same way and in the correct position, for example so that the material web is always provided in the same position, then both the two guide tracks and the two bearing journals are designed differently to prevent incorrect insertion.

Matching the mirror-image element pair of guide track and bearing journal is referred to as coding, and known codings comprise, for example, the diameter of the bearing journal and the gap width of the guide track, a bearing journal with a bearing channel and ridges on the guide track engaging therein, parallel non-rotational surfaces on the bearing journal and on the guide track, etc. By means of different codings it is possible in particular to avoid a dispenser being refilled with unsuitable rolls and to ensure that products adapted to one another are used (see European patent EP 1927308 B1, corresponding to U.S. Pat. No. 7,828,240).

A development of the above-described coding is shown in international patent disclosure WO 2013/123536 A2, corresponding to U.S. Pat. No. 9,756,993. The support bar (bearing unit) described therein for a material web wound to form a roll has a bearing journal which is rotatably mounted on the rest of the support bar. In the dispenser itself there is an apparatus (in the simplest case a rib which engages in a groove in the bearing journal) which holds the bearing journal in a non-rotatable manner. Since the bearing journal is rotatable relative to the rest of the support bar on which the material web is wound, the roll with the material web can rotate when in the dispensing position and thus the material web can be unwound even though—as already mentioned—the bearing journal is non-rotatably held. If an "incorrect" support bar is inserted, in which the rotatability of the bearing surface relative to the rest of the support bar is not provided, the roll cannot rotate when in the dispensing position and the dispenser is jammed. This function is as the whole referred to as "rotary coding".

SUMMARY OF THE INVENTION

The object of the invention is to specify a further coding option for a dispenser, a refill or an associated bearing unit.

This object is achieved by a refill as disclosed in the independent refill claims, a bearing unit as disclosed in the independent bearing unit claim and/or a dispenser as disclosed in the dispenser claims.

The essence of the invention is that a bearing journal of the refill or the bearing unit of the refill is axially displaceable, whereby an axial coding is possible: only refills, or bearing units for such refills, which have such an axially adjustable bearing journal function properly in a suitably designed dispenser, whereas refills or bearing units without such axial displaceability do not allow the material web to be dispensed. This axial coding can also be combined with a rotary coding according to international disclosure WO 2013/123536 A2.

Bearing units for refills having an axially adjustable bearing journal are already known per se, for example from British patent application GB 2362375 A. There, the bearing journal can be pushed axially into a bearing unit formed as an end cap to allow the refills to be packed into a transportation box in a more space-saving manner. This state of the art does not disclose an axial coding within the meaning of the invention which allows certain refills to be released or blocked depending on the axial displaceability of the bearing journal. Nor is there an inner defined end position of the bearing journal, in which the latter protrudes axially beyond the roll, since in the solution shown there the inner end position is flush with the material web, precisely in order that the possibility of compact transportation is provided. By means of the design according to the invention of the refill in a variant of the invention in which the axially adjustable bearing journal already protrudes axially beyond the roll when in the inner end position and can be moved axially outwards from there, the bearing journal can be detected more easily in a testing device of the dispenser and moved in order to verify the axial coding.

From the inserting position to the dispensing position, the axial length of the roll, corresponding to the width of the material web, preferably corresponds to the free space between the walls of the dispenser without any significant axial play. Since the portions of the guide track which are offset in the direction of the roll axis, thus in the direction of the axial length, have the effect that the length, protruding from the roll, of the bearing journal guided by the guide track has to change if the non-axially displaceable roll is to travel to the dispensing position, only refills which have an axially displaceable bearing journal can be used.

Therefore, the axial offset in the guide track and the adjustable length of the protruding bearing journal, which length can track the offset, allow a new type of coding (axial coding) and optionally also add a further design to known coding variants.

The axial offset of the guide track includes different solutions for the bearing unit since the length of the bearing unit increases or decreases depending on whether the offset portion of the guide track extends to a greater or lesser extent into the wall. A support bar is preferably in two parts, and the two parts can in particular be telescoped into one another. However, a support bar can also be in one piece if one region is formed in the manner of an accordion.

In one embodiment, it is provided that one portion offset in the direction of the roll axis is formed in each of the two guide tracks. Here, the lengths of the bearing units have to increase or decrease, wherein in a third option the distance between the two guide tracks can remain the same if the two portions are offset in the same direction.

If the opposing portions of the two guide tracks are offset in opposing directions, this preferably means an increase in the distance between the two guide tracks, with the result that each bearing unit must be extended, in particular by the bearing journal being pulled out. Conversely, it is also conceivable for the portions to be offset towards each other, with the result that the two bearing journals must be shortened. This design has the advantage that the guide tracks and the bearing journals are merely pushed towards one another in each case and no measures are required which allow the bearing journals to be pulled out, for example undercut slots or grooves as guide tracks and end portions on the bearing journals able to be engaged from behind.

In a preferred embodiment, to prevent incorrect refills being inserted, it is provided that the offset portion is provided close to the insertion position. As a result, the axial displacement of the bearing journal is required as early as at the start of the guide track, and an incorrect refill with a rigid bearing journal can be easily removed again.

In another preferred embodiment, it is provided that the offset portion is provided just before the dispensing position. While this solution makes it more difficult to remove incorrect refills, it protects the dispenser from damage resulting from the use of force to press an incorrect refill into the dispensing position since it generally cannot be accessed directly from the insertion position.

Following the offset in the guide track, the latter can jump back to the original position, wherein a pulled-out bearing journal is pushed back in and a pushed-in bearing journal is pulled back out to the original length. However, it is also possible to continue the guide track following the offset into the dispensing position parallel to the entry portion. This design is advantageous above all when the offset increases the distance between the guide tracks and a collection chamber for empty support bars is provided below the dispensing position. In this case, a preferred embodiment example of the invention provides that between the dispensing position and the collection chamber a second axially offset portion is provided, in which the distance between the two guide tracks is changed again, in particular increased further. A second increase leads to the two parts being completely pulled apart from one another, and thus each part is smaller than the support bar. Removing the smaller parts, and also disposal, is thereby made easier, in particular if material that disintegrates in water is used for the support bars.

The second axially offset portion can be provided in the same guide track as the first offset portion or in the opposite guide track, preferably below the dispensing position. There, the support bar can also be shortened again by a ramp or the like formed in the guide track, and can be dislodged from the two guide tracks.

Each guide track has an offset portion, thus the two bearing journals are preferably also formed to be engaged from behind. Suitable bearing journals are in particular those described in the aforementioned European patent EP 1 927 308 and provided, on the end, with a flange formed by a circumferential groove in the bearing journal, the flange having an end-face groove.

Length-adjustable support bars which can fit a guide track of a dispenser with an axially offset portion can preferably be lengthened out of a transportation position as early as in the insertion position. When in the transportation position, the support bar corresponds substantially to the axial length of the paper roll and thus has ideal conditions for the layered arrangement of the refills with support bars in packaging boxes since the bearing journals are countersunk into each roll. From this transportation position the bearing journals are pulled out to the defined inner end position required for the inserting position, and their axial protruding length is adjusted as described above when they pass the offset portions.

Instead of a two-stage extension one after the other in two offset guide track portions, the two parts of the support bar can also be separated immediately following the insertion position as early as when they pass the first offset portion of the guide track, since the roll in the dispenser is also sufficiently supported by the two parts of the support bar, which are no longer interlocking. Once the paper has been used up in the dispensing position, the separated parts thus already fall down from there.

If the support bars are not to be reused for new paper rolls, a further preferred embodiment can provide that, after being separated from one another, the two parts of the support bar can no longer be joined together, or can only be joined together in a very time-consuming manner, to form a support bar with adjustable length of the bearing journals. For example, the ends or edges, opposite the bearing journals, of the two parts can form spreading or breaking elements, tabs or the like which at least make the fitting together and telescopic displaceability extremely difficult.

As already mentioned, each guide track can be formed as an undercut or non-undercut groove, or as a slot able to be engaged from behind or not able to be engaged from behind, in the dispenser wall guiding the roll, or even as a projecting ridge, wherein the two bearing journals have the corresponding end regions, which ensure the axial movement out of or into the guide tracks. The bearing journals can thus have grooves in the end faces, end flanges with a larger diameter or circumferential grooves forming end flanges.

The invention contains not only a refill or bearing unit with at least one axially adjustable bearing unit, but also dispensers which are suitable for receiving such bearing units and refills.

In a dispenser, a guide track with a transition curve which alters the axial protruding length of the bearing journal is provided. This transition curve thus attempts to move the bearing journal axially. When this is successful, the coding is correct and the refill can reach the dispensing position or there enable the material web to be pulled off by rotating the refill. If the bearing unit or refill is formed such that there is no axially adjustable bearing journal, no dispensing takes place since, for example, the support bar sticks in the transition curve.

Accordingly, a dispensing system is provided containing a dispenser for portions of a refill and at least one refill with a material web wound to form a roll. The refill has at least one bearing journal, which can be guided in a guide track of the dispenser from an insertion position into a dispensing position. The refill is rotatably mounted when in the dispensing position. The dispenser has a testing device for verifying the axial displaceability of the bearing journal with respect to the roll of the refill. The dispensing of portions of the material web is released or blocked depending on the axial displaceability of the bearing journal.

With such a testing device, the axial coding can be verified. If the bearing journal is axially displaceable with respect to the roll of the refill, the refill is correctly coded and dispensing is possible. If, conversely, such an axial displaceability is not provided or not correctly provided (incorrectly coded refill), the material web is prevented from being dispensed. There are a wide range of options for this: for example, an incorrectly coded refill can be stopped on the way from an insertion position to a dispensing position before reaching the latter. However, it is also conceivable to prevent the refill from being rotated, and thus the material web from being dispensed, in the dispensing position if the axial coding is not correct. Further options for preventing the material web from being dispensed in the event of incorrect axial coding are also conceivable and possible.

Further advantages and details of the invention as well as preferred embodiments thereof will be described in more detail in the following description of the figures, without being limited thereto.

Other features which are considered as characteristic for the invention are set forth in the appended claims.

Although the invention is illustrated and described herein as embodied in a refill for a dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
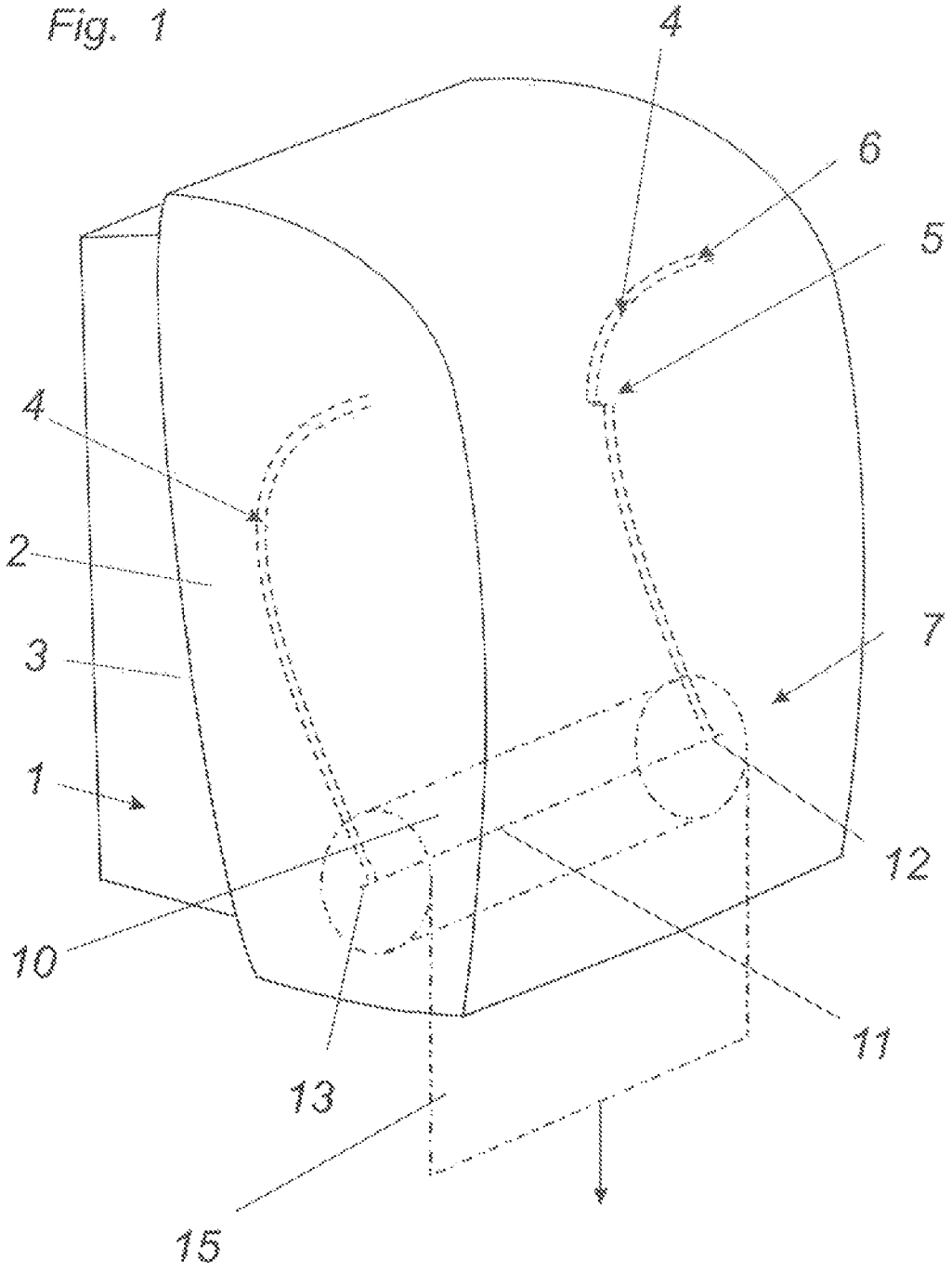
FIG. 1 is a perspective view of a dispenser for paper.

Referring now to the figures of the drawings in detail and first, particularly to FIG. 1 thereof. After being cut from a length, material webs 15 wound to form rolls 10 (refills), in particular of kitchen paper or toilet paper, generally require bearing journals 12, 13 protruding from the end faces of the roll 10 in order to be inserted into guide tracks 4 of a dispenser 1 (FIG. 1) after opening a cover 2, which tracks are formed in walls 3 of the dispenser 1, and in order to be rotatably mounted there when in a dispensing position 7. The bearing journals 12, 13 are provided at the ends of an axial support, in particular formed as a support bar 11.

To prevent the dispenser 1 being filled with incorrect rolls, close to the insertion position 6 at the beginning of at least one guide track 4 a catch formed by an axially offset portion 5 is formed, which can be overcome only by altering the length of the protruding length (i.e. by axial displacement) of the bearing journal 12 engaging in this guide track. If a refill with an incorrect support bar (without an axially displaceable bearing journal) is used, the roll cannot pass the offset portion 5 since the wound material web cannot be moved back and forth between the walls 3.

Figure 2:
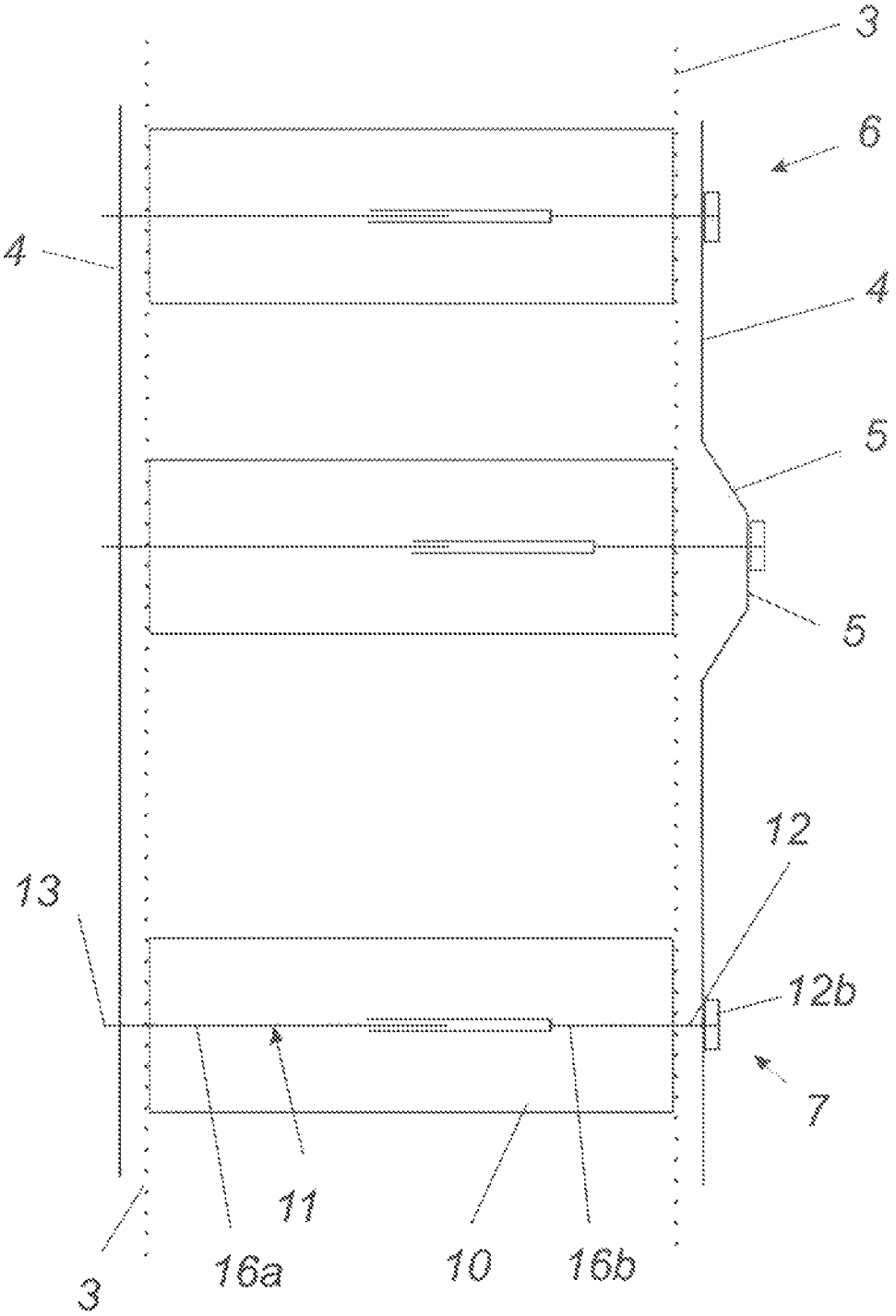
FIG. 2 is a schematic representation of a roll path between an insertion position and s dispensing position of the dispenser.

FIG. 2 shows a schematic sequence of inserting a roll 10 into the dispenser 1, of which only the walls 3, in dotted lines, and guide tracks 4 are shown, wherein the guide track 4 shown on the right contains two offset portions 5. The roll 10 contains the support bar 11, which consists of two axial parts 16*a*, 16*b* able to be slid into one another, each of which has a bearing journal 12, 13 protruding from the roll 10. The right-hand bearing journal 12 in the drawing has an end portion 18 able to be engaged from behind, for example a flange, which can be inserted into the guide track 4. The second bearing journal 13 can be formed cylindrical, wherein the associated guide track can be formed by a simple groove. As described in FIG. 4, however, the second guide track and the second bearing journal 13 can also have the same or different features.

If the roll 10 with the support bar 11 protruding on both sides is to be inserted into the dispenser 1, attention is to be paid firstly to the correct alignment; in other words, the bearing journal 12 provided with an end portion 18 able to be engaged from behind must be inserted into the guide track 4 provided with the offset portions 5. The uppermost representation in FIG. 2 indicates the insertion position 6, starting from which the guide track 4 extends at least as far as to the dispensing position 7, preferably even further into a collection chamber 8 for empty support bars 11.

After the insertion position 6 are the two offset portions 5 of the guide track 4, which are first offset to the right or outwards and then back again and which can thereby be passed by the support bar 11 on the way to the dispensing position 7, if they are able to extend the bearing journal 12 by means of sliding out axially and then shorten it again. This is possible due to the parts 16*a* and 16*b* of the support bar 11 able to be axially displaced into one another. The offset portions 5 of the guide track thus represent an example of a testing device with which the axial coding of refills can be verified.

In the process, a measure not described in more detail here prevents the part 16*a* from also being displaced and the bearing journal from sliding out of the guide.

As shown in this embodiment, following the offset portions 5 the guide track continues on the original line again, and the further path to the dispensing position 7 is clear as soon as the part 16*b* and the bearing journal 12 have been pushed back into the starting position again.

A support bar with a non-extendible or non-axially adjustable bearing journal and which cannot be displaced in the roll cannot pass the offset portions 5 of the guide track 4 since the roll is prevented from axially displacing by the walls 3 of the dispenser. An incorrect roll inserted in this manner can only be removed again from the insertion position 6.

Figure 3:
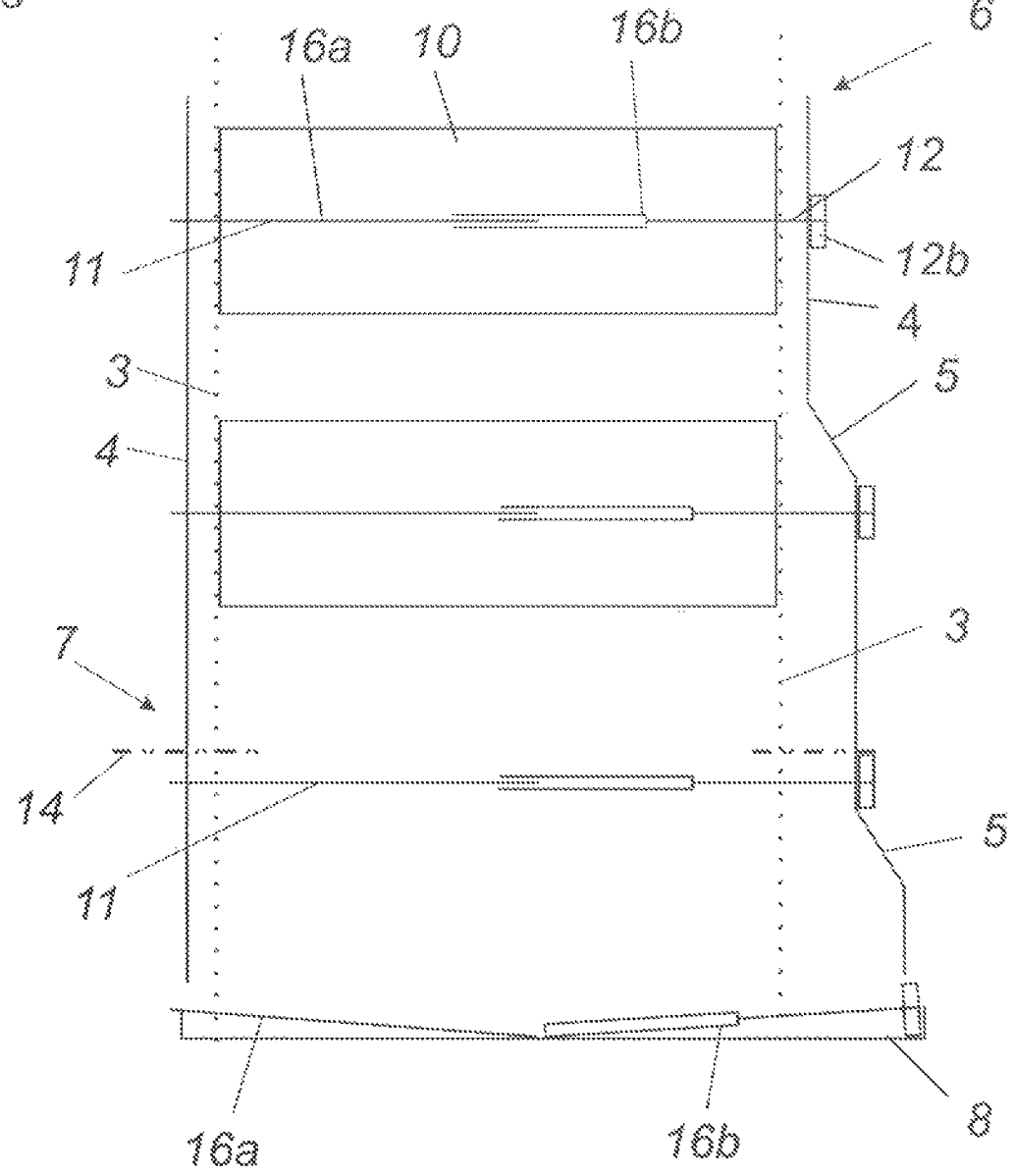
FIG. 3 is a schematic representation of the roll path between the insertion position and a collection chamber.

FIG. 3 likewise shows a schematic sequence similar to FIG. 2, wherein the most significant difference can be seen in that the guide track 4 drawn on the right has two offset portions 5, the first of which is provided close to the insertion position 6 and the second of which is provided just before, in or after the dispensing position 7. By means of the dot-dashed axis 14 of the roll 10, FIG. 3 indicates the dispensing position 7, which is followed by the second offset portion 5. Apart from the missing rebound, the sequence up to the dispensing position 7 is as described for FIG. 2. After the paper of the roll 10 has been used up, the empty support bar 11 is moved further downwards by gravity or by a subsequently fed-in new roll or refill in the guide and preferably enters the aforementioned collection chamber 8. On the way there, the empty support bar 11 must pass the second offset portion 5, in which the two parts 16*a* and 16*b* are completely pulled apart from one another and can thus be removed individually and are of a considerably shorter length than the original support bar.

If the material used for the support bar disintegrates in water, the two parts can also be disposed of in the waste water since the length of the two parts is now short enough for them to be able to pass through common waste pipes.

Figure 4:
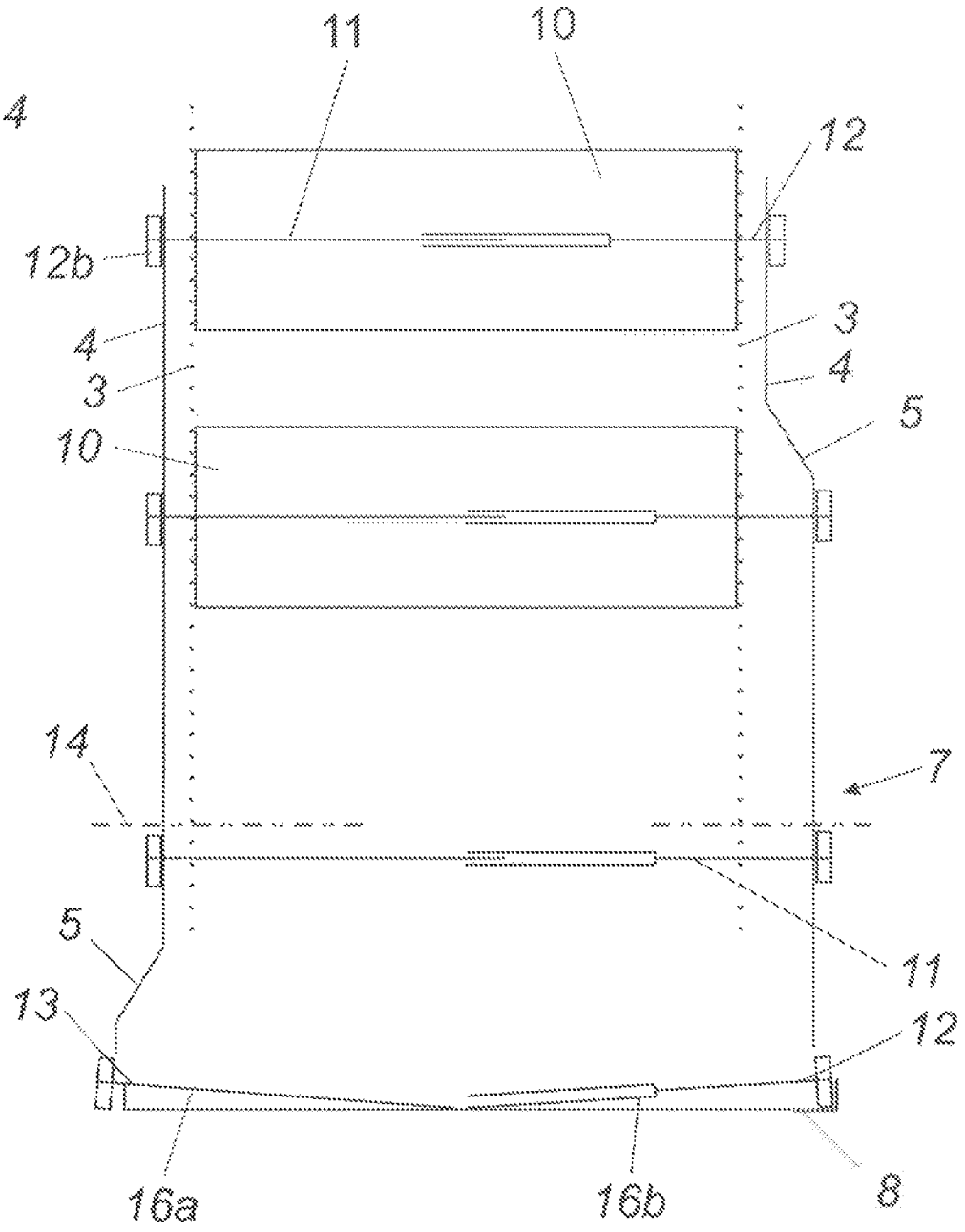
FIG. 4 is a schematic representation of the roll path between the insertion position and the collection chamber in a modified design.

FIG. 4 shows a variant of FIG. 3 in which the two offset portions 5 are distributed onto the two guide tracks 4. Thus, the first offset portion 5 of the right-hand guide track 4 is again close to the insertion position 6, and the second offset portion 5 is in the left-hand guide track, preferably after the dispensing position 7. In this design too, support bar halves fall into the collection chamber 8. The two bearing journals 12, 13 have end portions 18 able to be engaged from behind and slide in correspondingly shaped guide tracks 4, which prevent them from inadvertently leaving the guide track as they pass the two offset portions 5. On their end faces, the flange-like end portions 18 formed in particular outside a circumferential groove or outside a smaller-diameter portion of the bearing journals 12 have a radial groove 19, in which in the case of insertion into the guide track 4 a ridge 20 formed there engages (see also FIG. 5 to FIG. 8).

FIGS. 2, 3 and 4 schematically show two-piece support bar parts 16*a*, 16*b* which can be telescoped into one another and are provided with one or two bearing journals 12, 13 able to be engaged from behind, the protruding length of which out of the roll 10 can be adjusted.

Alternative constructions can achieve the same aim. By way of example, the following may be mentioned.

The distance between the guide tracks 4 can also become smaller if the portion 5 is offset inwards into the roll-receiving space. When passing the offset portion 5, the bearing unit then becomes shorter overall.

At the same height the two guide tracks 4 can have portions 5 offset in the same direction, wherein the length of the bearing unit suitable for this design does not change since the distance between the guide tracks 4 is the same everywhere. However, the axial protruding lengths of the two bearing journals 12, 13 do change.

Figure 29:
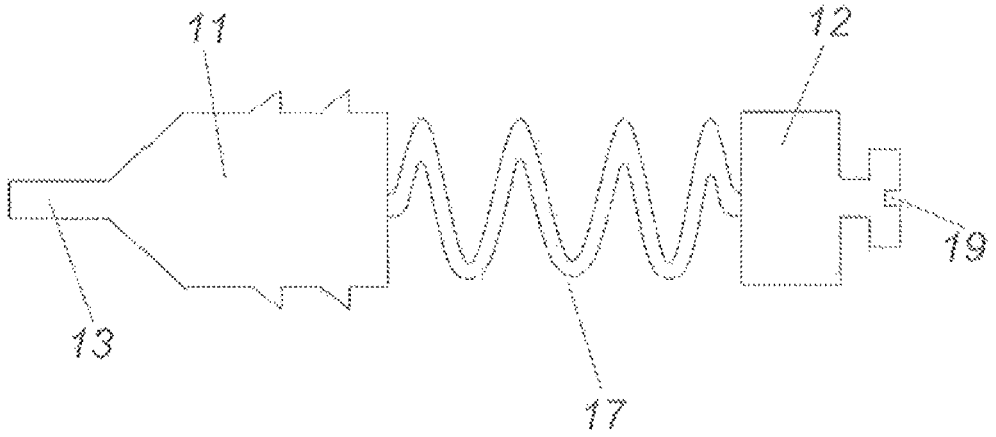

The support bar 11 can also be a single piece if between the two bearing journals it has a length-adjustable region formed for example in the manner of an accordion, and thus the axial displaceability of at least one bearing journal is produced (see also FIG. 29).

Figure 10:
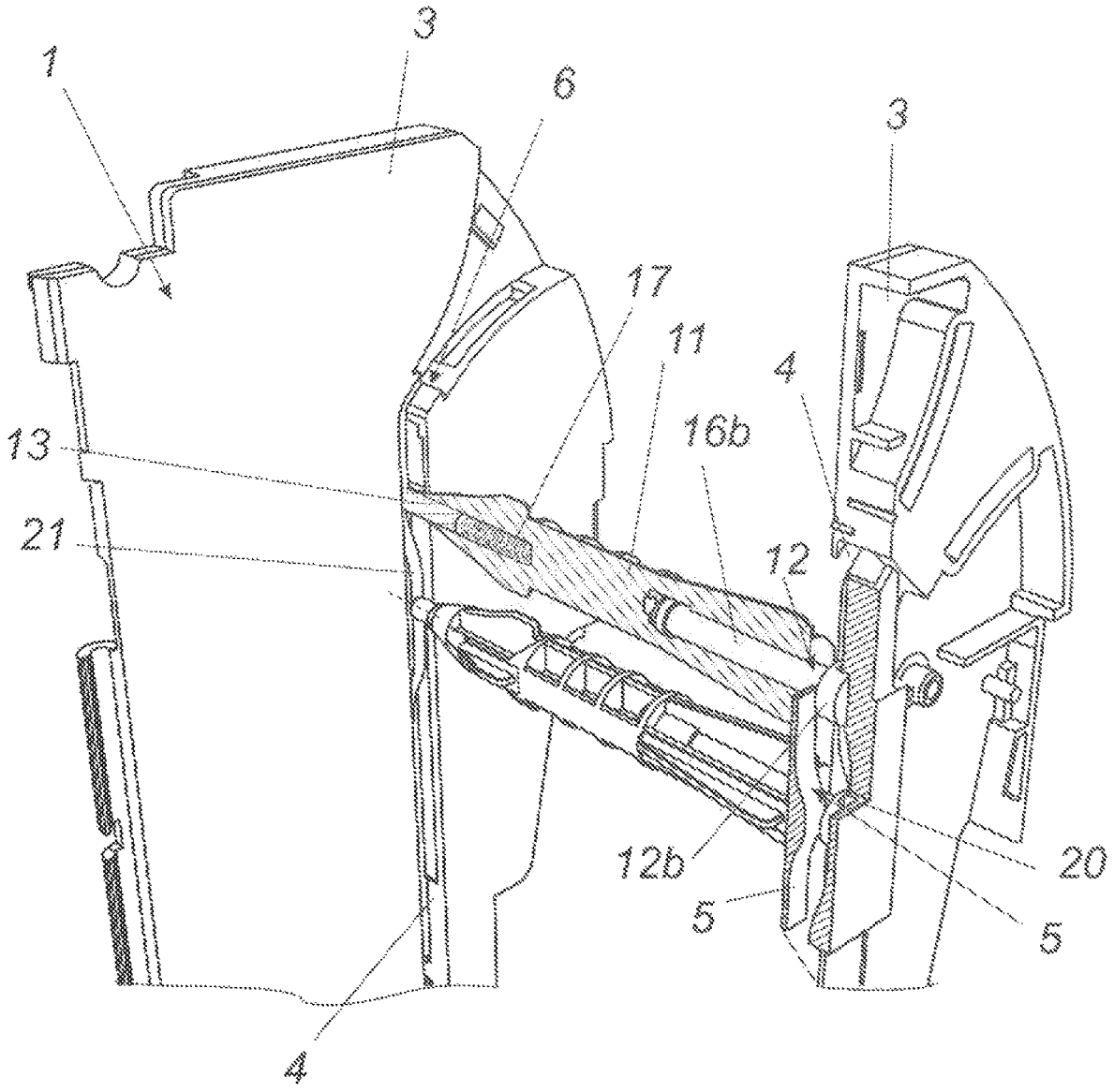
FIG. 10 is a cutaway, perspective view of the toilet paper dispenser with views of a second design of a support bar in two positions.
Figure 25:
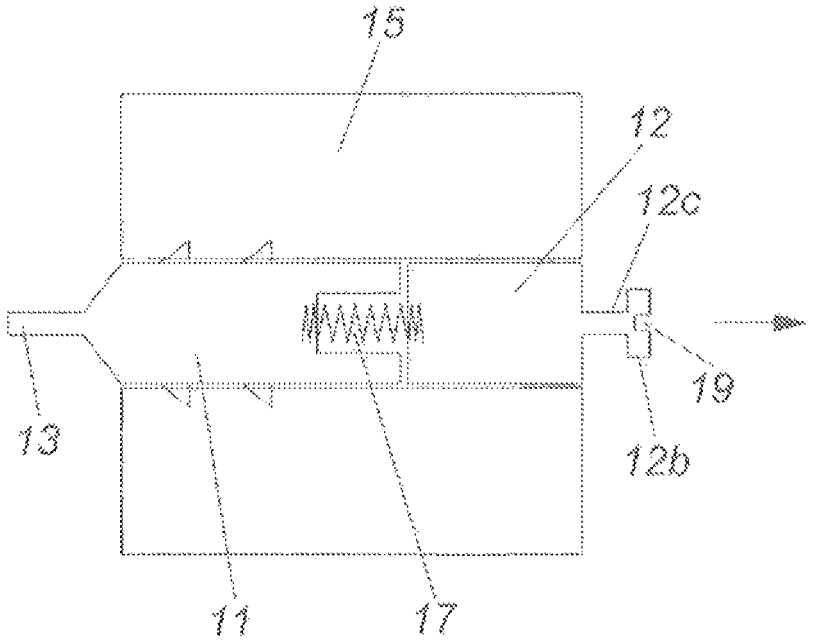
FIG. 25 is an illustration of an embodiment example of the refill according to the invention in an axial longitudinal section.

Between the two parts 16*a*, 16*b* the support bar 11 can have a spring 17, which is shown for example in FIG. 10 or also FIG. 25, if the bearing journal 13 is formed cylindrical and not able to be engaged from behind.

FIGS. 5 to 8 show in detail how a groove 19, formed on the bearing journal 12, in the support bar 11 engages in a guide track 4 according to FIG. 2, in which two offset portions 5 are provided one below the other, with the result that the portions of the guide track 4 lying above and below are aligned parallel to one another. The two offset portions 5 merge into one another in a transition curve running in a wave-like manner (e.g. in an Agnesi curve).

In this design, the guide track 4 has a cross section which, starting from a U-shape, is provided with two ridges 21 pointing inwards on the free ends of the legs and the ridge 20 projecting in the centre parallel to the two legs. In each case, just one part 16*b* of the two axially displaceable parts 16*a*, 16*b* of the support bar 11 is shown. FIGS. 5 to 8 each show two support bars 11 or their parts 16*b* directly one after the other in order to more clearly illustrate the axial offset v as they pass the offset portions 5.

Figure 9:
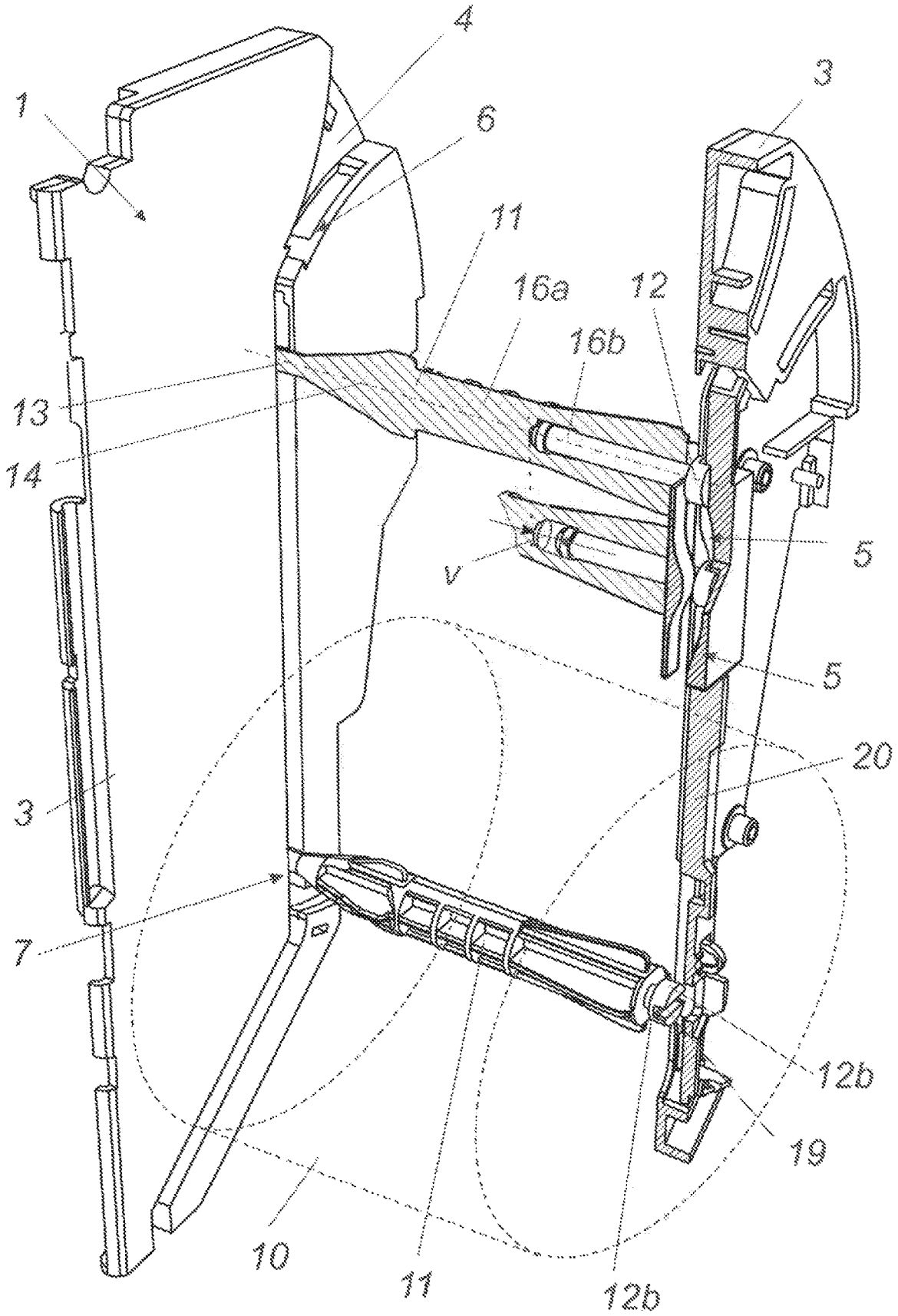
FIG. 9 is a cutaway, perspective view of a toilet paper dispenser with views of a support bar in two positions.
Figure 11:
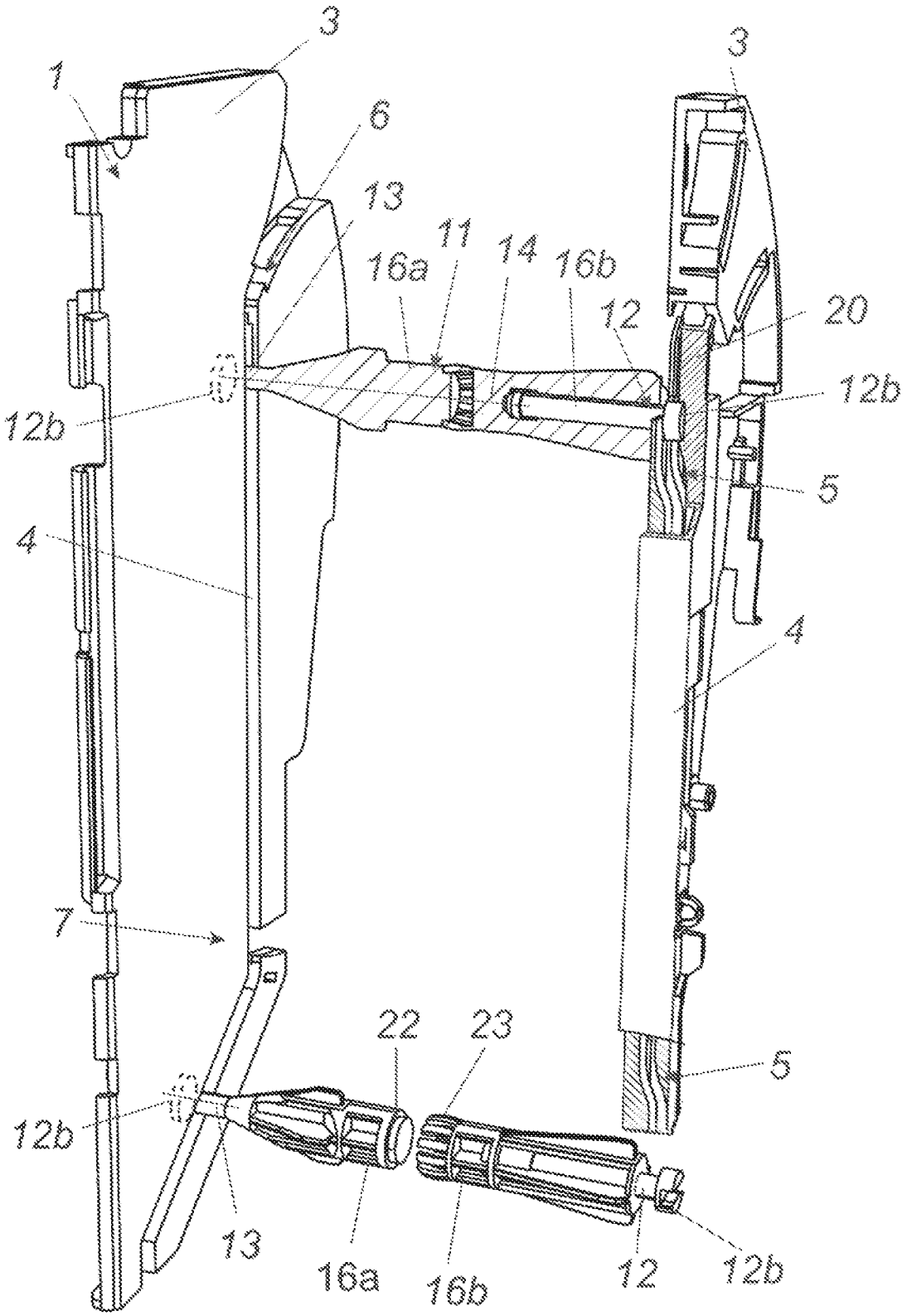
FIG. 11 is a cutaway, perspective view of the toilet paper dispenser with views of a third design of a support bar in two positions.

FIGS. 9 to 11 show cutaways of toilet paper dispensers from the rear side, not represented, which can be attached to a wall or the like. Parts of the walls 3 of the dispenser 1 are represented, wherein a single slot is provided in the left-hand wall 3 in the drawing as a guide track, in which a cylindrical bearing journal 13 engages. For the sake of clarity, the length of the second guide track 4 on the right-hand side of the drawing has been cut and its cross section corresponds to the negative of the end portion 18 of the bearing journal 12, as described above, which forms a flange able to be engaged from behind and is provided with an end-face groove 19, in which the ridge 20 of the guide track 4 slides. With the part 16*b* the bearing journal 12 is arranged rotatably in the part 16*a*, with the result that the roll 10 with the part 16*a* of the support bar can be rotated about the axis of rotation 14 at any point in the guide tracks 4, even if the part 16*b* or its bearing journal 12 is held in the dispenser on the ridge 20 non-rotationally with its groove 19 (additional rotary coding).

With the roll in the dispensing position 7, FIG. 9 shows a position of the bearing journal 12 in which the end-face groove 19 is approximately horizontal. As is clear from the width of the sectional area of the ridge 20, the latter ends just above the dispensing position 7 and the end portion 18 of the bearing journal 12 can rotate here as desired.

When passing the two offset portions 5, the part 16*b* is pulled outwards while the part 16*a* remains in place since it is prevented from doing that by the winding of the paper. When passing the first offset portion 5, the axial extension of the bearing journal is visible in the support bar, which is merely outlined. The letter v denotes the size of the outward offset that is preferably larger than the depth of the opposite guide track 4. A support bar which is unsuitable because it is not extendible would in this case be pulled out of the second guide track, whereby the dispenser is jammed (axial coding) and the material web is prevented from being dispensed.

FIG. 10 shows a similar view to FIG. 9, but the lower region of the dispenser has been omitted. Here, two support bars 11 are shown one after the other, the upper of which is shown in section again just after the insertion position 6. The pin-like bearing journal 13 on the left-hand side of the support bar 11 in the drawing is spring-mounted in a hole and the spring 17 pushes the bearing journal 13 outwards into the guide track 4. The other bearing journal 12 in turn has the specially shaped end portion 18 with an end-face groove 19 and interacts with the right-hand guide track 4 in the drawing. Corresponding to the two offset portions 5, on the right in the guide track 4 a rib 21 is formed, by which the bearing journal 13 is pushed into the support bar 11 against the spring 17 when the bearing journal 12 is pulled out as it passes the offset portion 5, as described above. The spring 17 ensures that the bearing journal 12 remains pushed into the guide track 4 when the roll 10 slides downwards into the dispensing position 7 and the rib 21 is overcome.

FIG. 11 shows a similar view to FIGS. 9 and 10. The part 16*b* again carries the bearing journal 12 with the end portion 18 which is pulled out of the part 16 by the offset v when the offset portion 5 is passed. The further portion of the guide track 4 downwards into the dispensing position 7 runs in the offset plane, with the result that the part 16*b* cannot be pulled out any further and the protruding length of the bearing journal 12 cannot be increased any further. Following the dispensing position 7, the guide track 4 contains a second portion 5 which is again offset outwards and which the empty support bar 11 must pass after the paper has been used up. Since the bearing journal 13 is likewise engaged from behind by the guide track 4 shown on the left-hand side, the part of the support bar 11 provided with a break point is dismantled and the two significantly smaller pieces of the empty support bar 11 remain and slide further downwards into a collection chamber. The break point contains for example the collar 22 shown and the elastically pretensioned claws 23 which engage on the collar 22. After being dismantled into the two smaller parts 16*a*, 16*b*, it is now difficult or impossible for the support bar 11 to be put back together without corresponding tools, with the result that reuse is made more difficult. The representation in FIG. 11 more or less corresponds to the diagram in FIG. 4.

Figure 12:
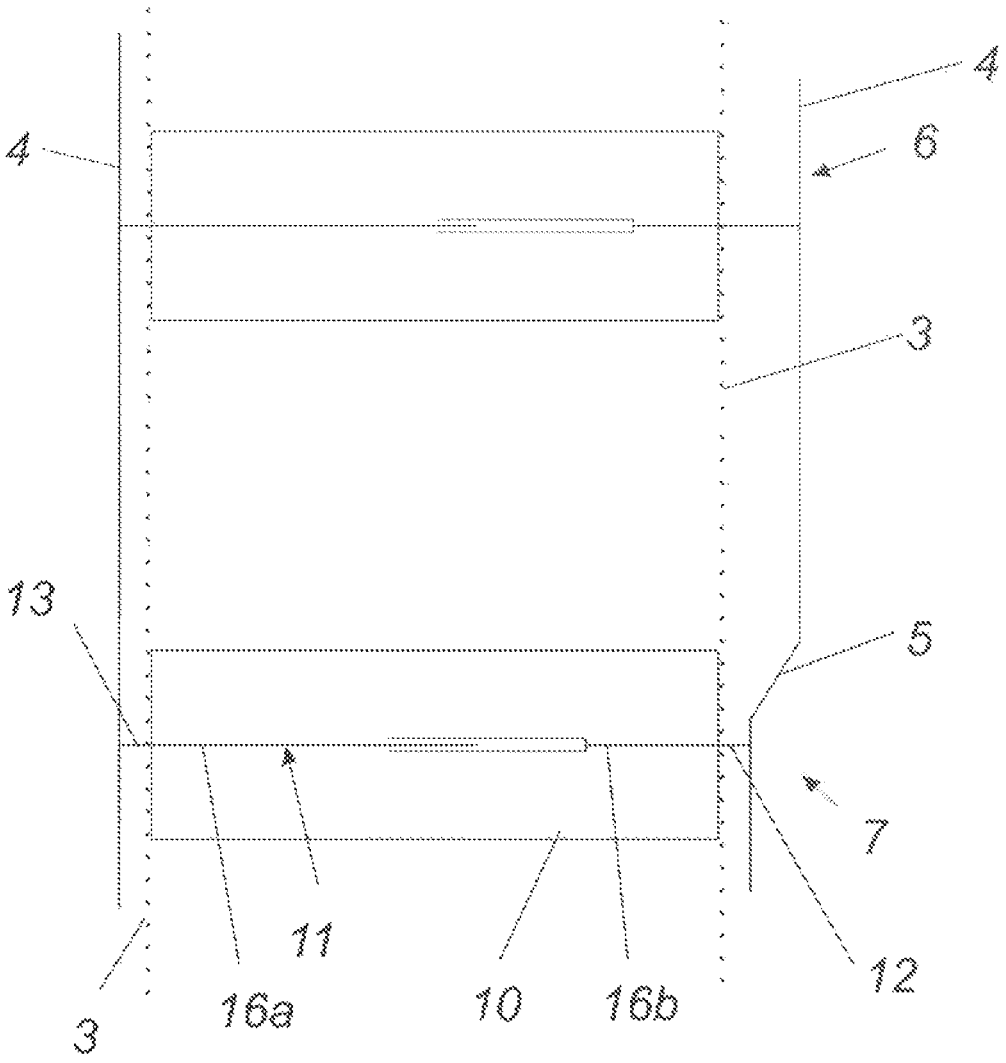
FIG. 12 is a further schematic representation of the roll path similar to FIG. 2.

FIG. 12 shows a further schematic sequence of inserting a roll 10 into a dispenser 1, of which walls 3 and the guide tracks 4 are again shown. In the region of the insertion position, the distance between the two guide tracks 4 is larger than immediately before the dispensing position, where the portion 5 is offset inwards. The bearing journals 12, 13 have cylindrical ends without any special engagement elements since the right-hand bearing journal in the drawing is pushed further into the roll as it passes the offset portion 5. Optionally, a spring, a compressible foam insert or the like can be provided between the two parts 16*a* and 16*b*.

The above description of embodiment examples of the invention can thus be summarized as follow.

In a dispenser for portions of a material web wound to form a roll, in particular a paper dispenser, a roll 10 with the wound material web is guided axially from an insertion position 6 to a dispensing position 7 between parallel, opposing walls 3. On both sides, the roll 10 has axially protruding bearing journals 12, 13 and guide tracks 4 for the roll 10 are assigned to both walls 3. On at least one side of the dispenser, at least one offset portion 5 is formed in the guide track 4, and when passing this the axial protruding length of the bearing journal 12, 13 is altered in the direction of the roll axis 14 as the roll 10 guided between the walls travels to the dispensing position.

Figure 13A:
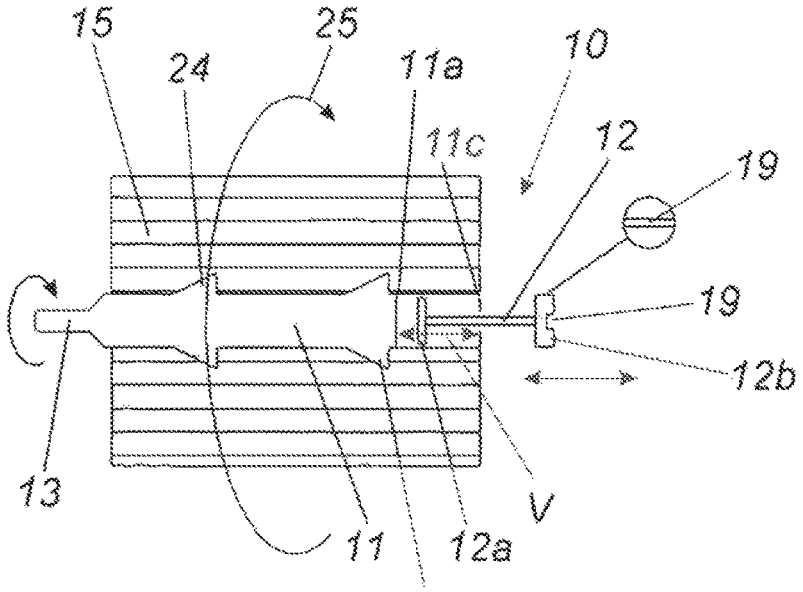
FIG. 13*a* is an illustration of an embodiment example of a refill according to the invention with a continuous axial support and an axially displaceable bearing journal.

In the embodiment example represented in FIG. 13*a*, a refill for a dispenser with a material web 15 wound to form a roll 10 is shown, wherein the bearing journal 12 is mounted in an axially adjustable manner. The left-hand bearing journal 13 is rigidly connected to an axial support (support bar 11).

The axially adjustable bearing journal 12 has an inner stop 12*a*, which cooperates with an inner counter-stop 11*a* of the support bar. If the stop 12*a* abuts the counter-stop 11*a*, the defined inner end position of the bearing journal 12 is reached. When in this end position, the latter or the head 12*b* thereof, which is provided with a radial groove 19, still protrudes beyond the roll 10 and can thus be easily detected by a testing device, not shown here, in the dispenser.

Figure 13B:
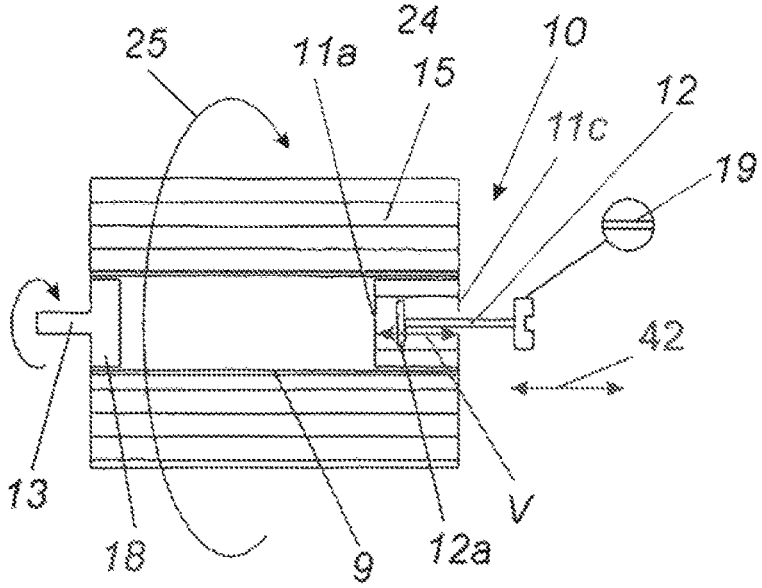
FIG. 13*b* is an illustration of an embodiment example with two end caps inserted at the sides, likewise in a schematic longitudinal section.
Figure 13C:
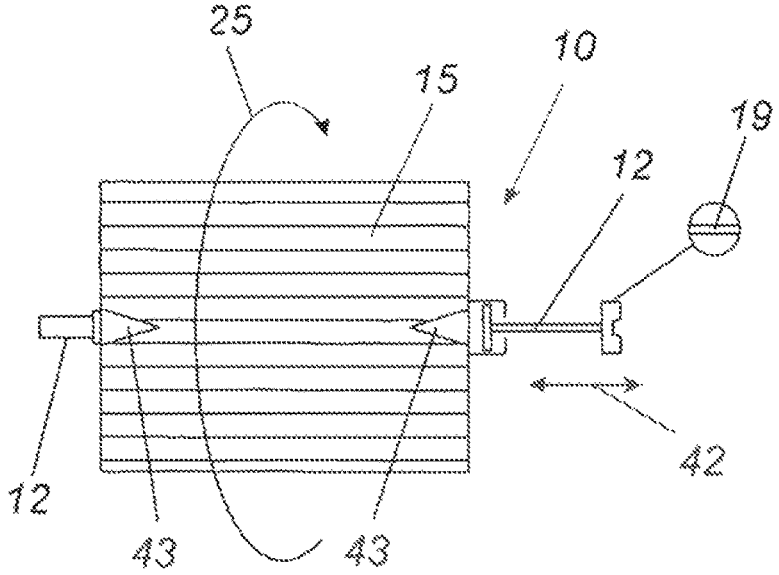
FIG. 13*c* is an illustration of an embodiment example with two bearing tips inserted at the sides, likewise in a schematic longitudinal section.

In FIGS. 13*a*-13*c* the radial groove 19 is represented again in a schematic end view at the top right.

In the embodiment example represented in FIG. 13*a* the right-hand bearing journal 12 is mounted so as to be adjustable between a defined inner end position and a defined outer end position and protrudes axially beyond the roll 10 in both end positions. The outer end position is defined by the stop 12*a* striking against the counter-stop 11*b*. The axial travel is denoted by v. It is preferably 3 mm to 30 mm, more preferably 5 mm to 20 mm.

The advantageous diameters of the support bar 11 are between 0.5 cm and 3 cm.

With the construction represented in FIG. 13*a*, it is possible to implement an axial support which is as the whole substantially in two parts and by which a bearing journal 12 is axially displaceable by the amount v and is simultaneously held captively between the two end positions. It is clear that FIG. 13*a* is a schematic representation. In practice, the mounting of the bearing journal 12 in the axial support can of course be designed improved by means of suitable sliding guides and fits.

The embodiment with an axial support connected to the roll 10 allows this to be sturdily anchored in the material web 15, which is wound to form a roll. For the anchoring, radially projecting protrusions 24 can be provided, which are formed wing-shaped in the embodiment example represented in FIG. 13*a*. Such a design allows the support bar 11 to be axially pressed into the already wound material web. After the pressing-in, the protrusions 24 ensure that the axial support is in each case held in the roll 10 non-rotationally, as well as non-axially-displaceably when the usual forces occur. The relatively loose axially displaceable coding part is formed by the bearing journal 12, which can be moved in a defined manner between two end positions.

The embodiment example represented in FIG. 13*a* is a material web 15 which is advantageously wound to form a coreless roll 10, and thus allows a long material web to be wound in the case of a given external diameter.

To implement an axial coding, in which it is defined in the dispenser whether a bearing journal is axially displaceable with respect to the refill (roll 10), is it sufficient in principle if—as shown in FIG. 13*a*—just one of the two bearing journals is axially displaceable, namely the right-hand bearing journal 12. This allows a simpler construction since the left-hand bearing journal 13 can be formed, for example, as an injection-molded part in one piece with the support bar 11 (axial support) preferably consisting of plastic.

In the embodiment example represented in FIG. 13*a*, the axial support is formed as a continuous support bar 11 which extends substantially through the entire roll 10, wherein bearing journals 12, 13 protrude on both sides. This allows a good, precise mounting, in particular of material webs wound in a coreless manner.

In the embodiment example represented in FIG. 13*b*, two axial supports are provided, namely a left-hand and a right-hand end cap 18, which are inserted from the outside into the cylindrical cardboard core 9 in a clamping manner. The material web 15 is then wound around this cardboard core 9 to form a roll 10.

The left-hand end cap 18 has a standard design and has a bearing journal 13 connected to it in one piece.

According to a preferred embodiment of the invention the right-hand end cap 18 has a special design. Namely, it guides an axially displaceable second bearing journal 12 which, similarly to the bearing journal in FIG. 13*a*, is axially displaceable by the amount v. Again this is a schematic drawing. The precise mounting of the bearing journal 12 in the end cap 11 on the right can of course be designed slightly differently in detail in order to meet the requirements in the case of use in a dispenser.

FIG. 13*c* again shows a possible mounting for a material web wound in a coreless manner. Here, there are again two separate axial supports, which are formed in this case as retaining tips 43, which are pushed into each opposite end of the roll 10 wound in a coreless manner.

The relative axial displaceability of the bearing journal 12 to the right is implemented similarly to the embodiments according to FIGS. 13*a* and 13*b*. Again, the axially displaceable bearing journal 12 is held axially displaceable, but ultimately captive, between two defined end positions, one inner and one outer, defined by stops.

In all the embodiments according to FIGS. 13*a*, 13*b* and 13*c*, in addition to the axial coding, a rotary coding is also provided, in which the bearing journal 12 is mounted not only axially displaceable, but also rotatable, to the right with respect to the roll 10 or axial support.

Figure 5:
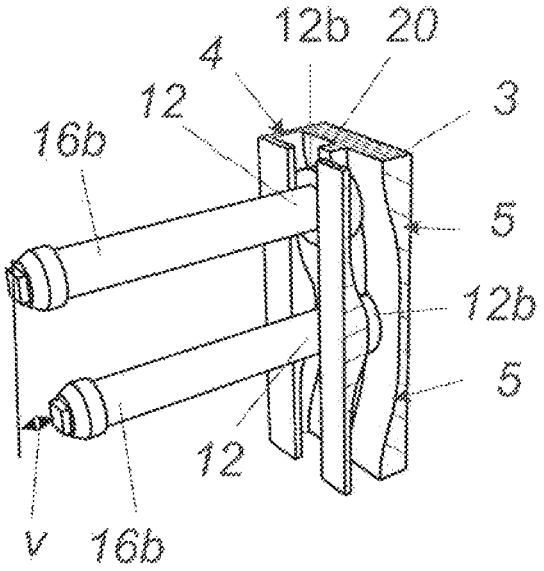
FIGS. 5 to 8 are various perspective views of cutouts of two offset portions of a guide track according to FIG. 2, with a part of a support bar.
Figure 7:
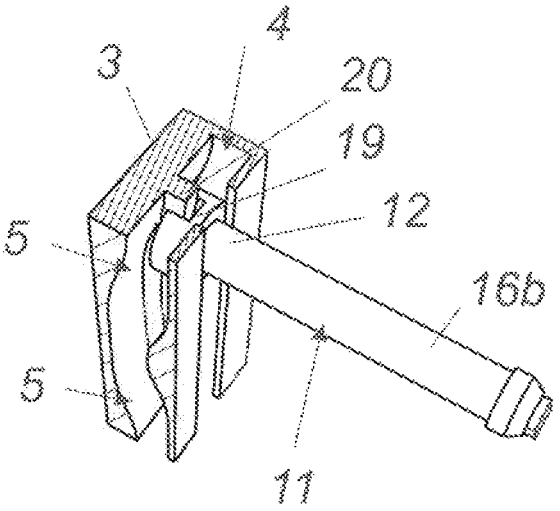
Figure 6:
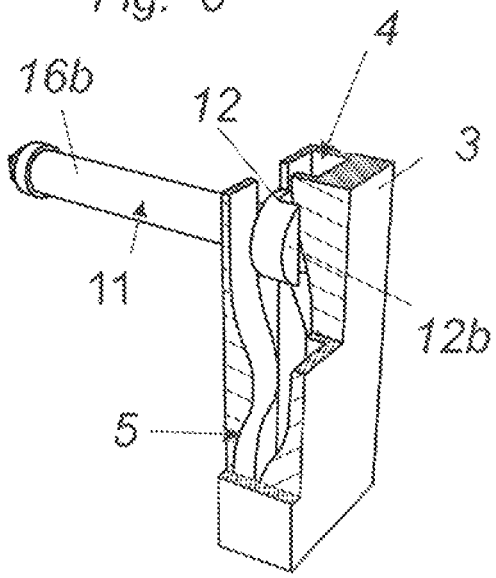
Figure 8:
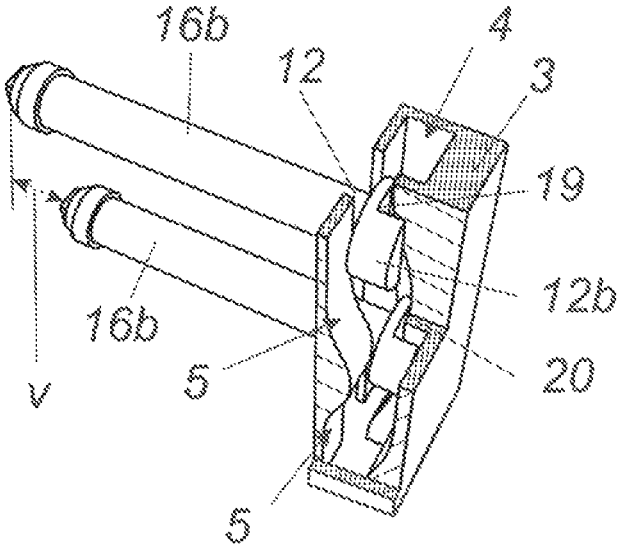

When inserted into a dispenser, the groove 19 in the head 12*b* of the right-hand bearing journal 12 enters a ridge 20, as shown in FIG. 5 for example. As a result, the bearing journal 12 as a whole is non-rotatably held and would prevent the roll 10 from rotating in the direction of the unwinding arrow 25. Despite the bearing journal 12 being non-rotatably held, the material web can be unwound in the direction of the unwinding arrow 25 solely due to the bearing journal 12 being rotatably mounted relative to the axial support (and this is the implementation of the rotary coding). In the case of the left-hand bearing journal 13, this can easily rotate in a guide track, not represented here, of the dispenser. Namely, it is sufficient for the axial coding and the rotary coding to be implemented on one side, on the right in FIGS. 13*a*, 13*b* and 13*c*.

In principle, the rotation of the (right-hand) bearing journal 12 with respect to the roll 10 can also be implemented by the axial support being held sliding in the roll—with regard to the rotation. However, better anchoring results when the axial support is relatively rigidly connected to the roll, and the possibility of rotation of the (right-hand) bearing journal 12 is produced by the latter being rotatably mounted relative to the axial support and rotatably held therein.

The material web can be for use in a sanitary dispenser, advantageously toilet paper preferably provided with tear-off perforations.

However, it is also possible for the material web to be paper towels—preferably formed without tear-off perforations.

In addition to paper material webs, however, other material webs such as for example cling film or other plastics films also come into consideration. Even metal foils, in particular aluminum foils, can be wound to form a material web and used in the invention.

In addition to rolls which are wound around a cardboard core 9, as shown in FIG. 13*b*, it is also possible to use rolls which are not coreless but still do not have a separate cardboard core 9. Then the end caps are inserted easily directly into the cavity in the material web roll, or the material web roll is wound around the end caps.

In the embodiment examples represented in FIGS. 13*a* to 13*c*, the rotary coding is implemented by designing the head 12*b* of the bearing journal 12 to be non-rotationally symmetrical, wherein the groove 19, which runs radially, provides the non-rotationally symmetrical shape.

Figure 14A:
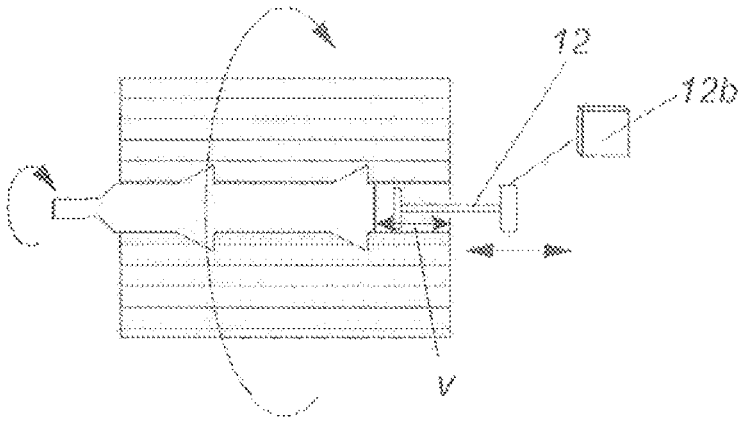
FIGS. 14*a* to 14*c* are illustrations showing alternative embodiment examples to those of FIGS. 13*a* to 13*c;*
Figure 14B:
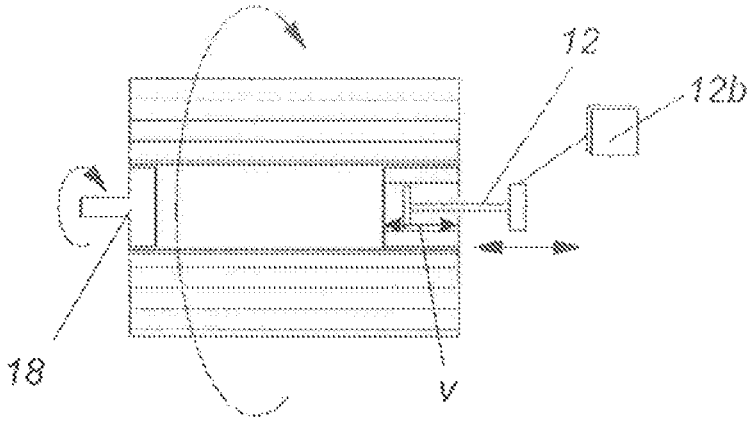
Figure 14C:
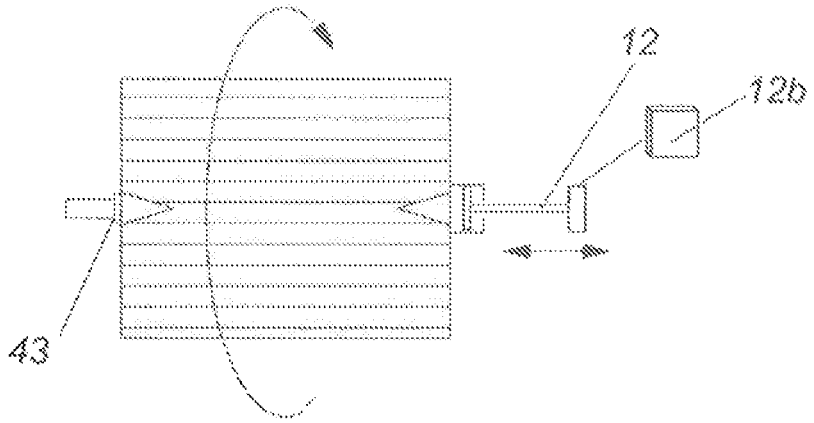

In the embodiment example represented in FIGS. 14*a* to 14*c*, the conditions are substantially the same as in the embodiment examples according to FIGS. 13*a* to 13*c*. Only the shape of the head 12*b* of the bearing journal 12 on the right is different, wherein a square (or generally polygonal) head is provided instead of the groove 19. This can also be easily held non-rotationally in a dispenser, not represented, or the guide track thereof.

Figure 15A:
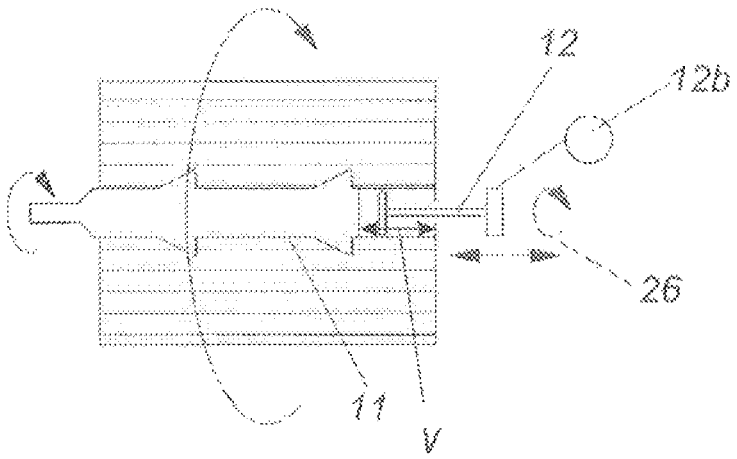
FIGS. 15*a* to 15*c* are illustrations of alternative embodiments to those according to FIGS. 13*a* to 13*c;*
Figure 15B:
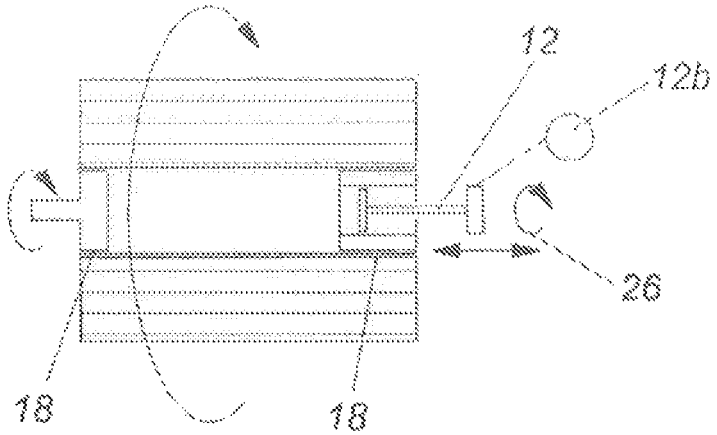
Figure 15C:
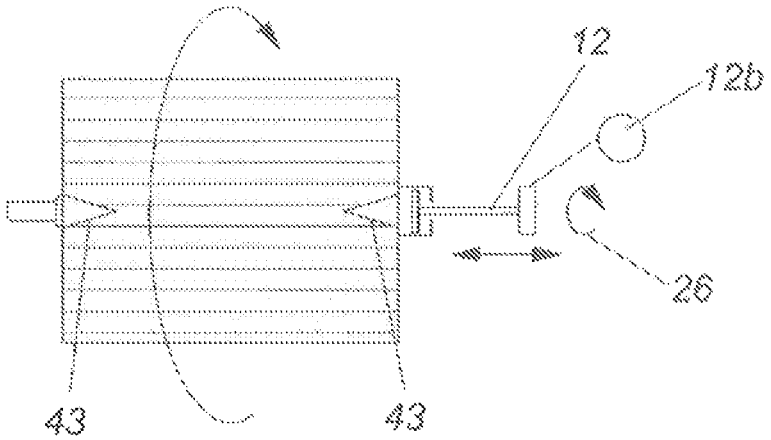

As shown by FIGS. 15*a* to 15*c*, which again largely correspond to FIGS. 13*a* to 13*c*, it is also possible for the head 12*b* of the bearing journal 12 to be formed rotationally symmetrical and thus to be able to rotate therewith in the dispenser in the direction of the small arrow 26. It is therefore not necessary, and in this embodiment example preferably also not provided, that the bearing journal 12 can rotate with respect to the axial support. No rotary coding is provided in this embodiment example. Although this rotary coding is preferably possible precisely for the concept of the invention, it is not required. To make the concept of the invention of the axial coding possible, it is sufficient if at least one of the two axial journals (here the right-hand bearing journal 12) is mounted axially displaceable.

Figure 16A:
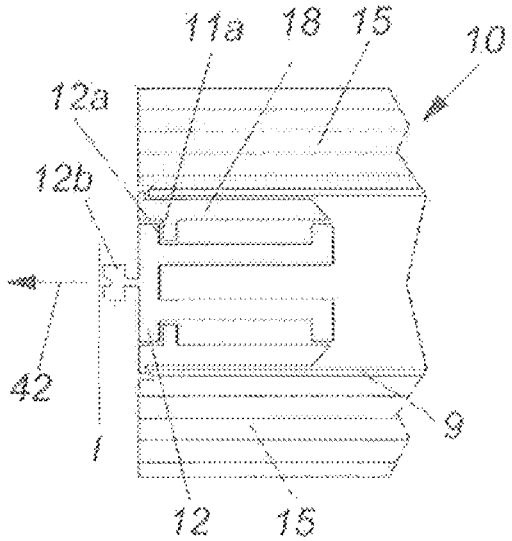
FIG. 16*a* a part of a bearing unit in a schematic longitudinal section (left-hand end cap with axially pushed-in bearing journal)
Figure 16B:
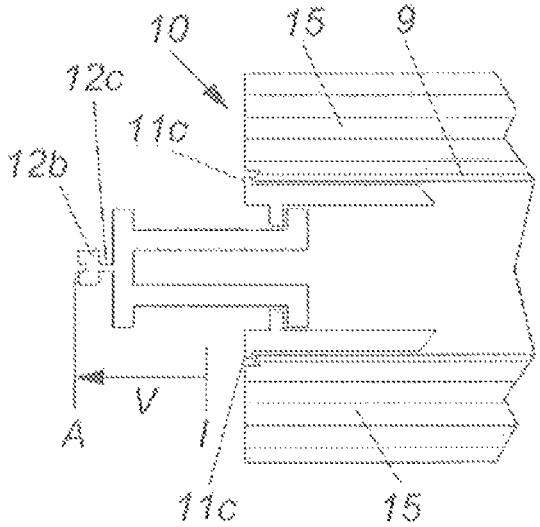
FIG. 16*b* is an illustration of a same representation with the axially offset bearing journal pulled out.

In the embodiment example represented in FIGS. 16*a* and 16*b*, an embodiment example of a bearing unit according to the invention is shown, in this case on the left-hand side of a schematically indicated roll 10, consisting of a wound material web 15. The bearing unit itself has an axial support, which can be pushed, for example, into a cardboard core 9 of the roll 10. Small limit stops 11*c*, which are formed by a radially protruding flange, prevent the axial support, formed the end cap 18, from being pushed too far into the roll 10.

FIG. 16*a* shows the defined inner end position I, in which the head 12*b* of the bearing journal 12 still protrudes beyond the end face of the roll 10 (wound material web 15). This inner end position is defined by flange-like stops 12*a* and counter-stops 11*a*. In other words, due to these stops 12*a* and 11*a*, the bearing journal 12 cannot be pushed further inwards. However, to implement the axial coding according to the invention, it can be pushed outwards following the direction of the arrow 42, namely by the amount v in order to reach the outer end position A, which is shown in FIG. 16*b*. This outer end position is in turn also defined by similar stops and counter-stops.

The invention relates not only to a refill, but also to a bearing unit for such a refill, wherein the bearing unit has an axial support, which can be inserted into a material web 15 wound to form a roll 10 and is mounted axially displaceable with respect to the at least one bearing journal. By way of example, these bearing units are shown on the right in FIGS. 13*a* to 15*c* and can also be sold separately without a material web 15 which is wound to form a roll 10.

Figure 17A:
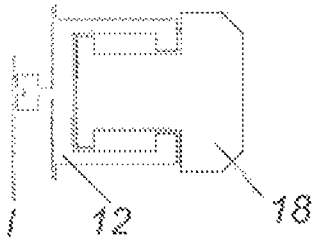
FIGS. 17*a* and 17*b* are illustrations of alternative construction options to FIGS. 16*a* and 16*b;*
Figure 17B:
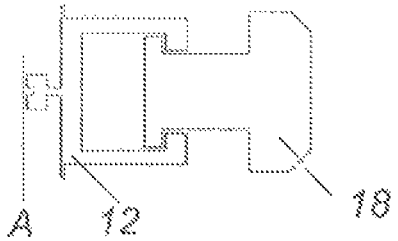

FIGS. 17*a* and 17*b* show an alternative embodiment of a bearing unit according to the invention, in which the bearing journal 12 surrounds the axial support instead of being pushed into it, as shown in the embodiment example according to FIGS. 16*a* and 16*b*. FIG. 17*a* shows the inner end position, FIG. 17*b* the outer end position. The two end positions are defined by stops and counter-stops.

Figure 18A:
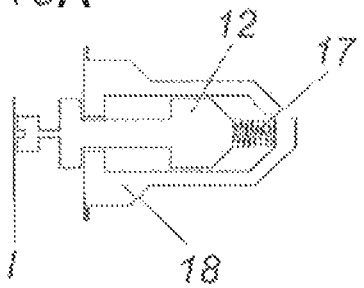
FIGS. 18*a* and 18*b* are illustrations of alternative construction options to FIGS. 16*a* and 16*b;*
Figure 18B:
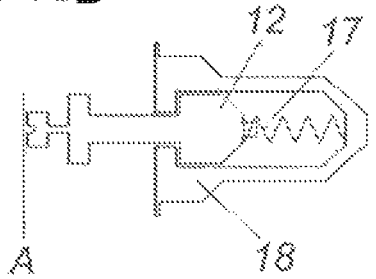

In the embodiment examples shown in FIGS. 18*a* and 18*b*, the inner and outer end positions, which are defined by stops and counter-stops, are shown again. A spring 17 is provided. According to FIG. 18*b*, this spring 17 always attempts to push the bearing journal 12 into the outer end position A. To move the bearing journal 12, a testing device provided in a dispenser then only needs to apply force in one direction, namely from the outer end position to the inner end position. The spring 17 does this in the other direction. Simpler testing devices acting "one-dimensionally" in terms of force are thus possible.

Figure 19A:
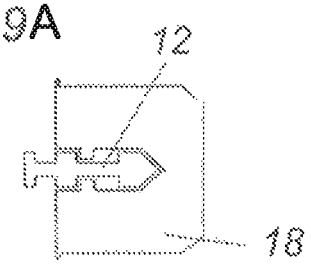
FIGS. 19*a* and 19*b* are illustrations of alternative construction options to FIGS. 16*a* and 16*b;*
Figure 19B:
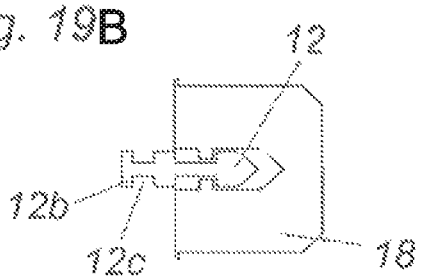

FIGS. 19*a* and 19*b* show two further embodiment examples which are formed similarly to the end caps according to FIGS. 16*a* and 16*b*. Only the mounting and the stops and counter-stops for defining the outer and inner end positions are slightly different structurally.

Figure 20A:
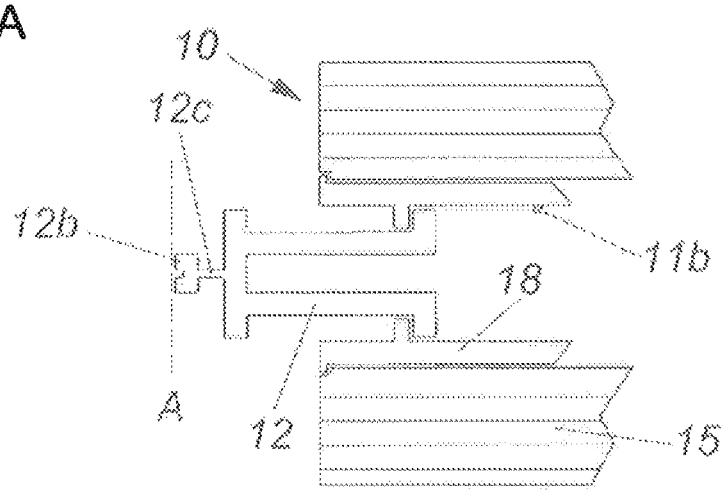
FIGS. 20*a* to 20*c* are illustrations of an embodiment example of a bearing unit (left-hand end cap) with three different positions of the axially displaceable bearing journal.
Figure 20B:
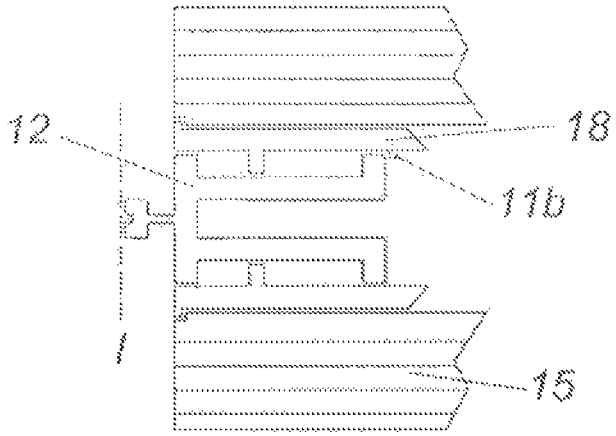
Figure 20C:
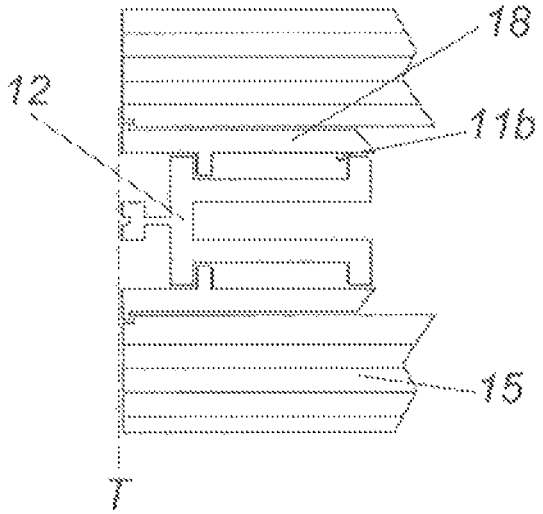

In the embodiment examples of a refill according to the invention or bearing unit according to the invention represented in FIGS. 20*a* to 20*c*, starting from a construction similar to that of FIGS. 16*a* and 16*b*, there is a traversable inner counter-stop 11*b* which defines the inner end position I, as shown by FIG. 20*b*. Since counter-stop 11*b*, which consists for example of a small, traversable—optionally resilient—hump, can be traversed in its entirety, it can fulfill two functions. First it can set the defined inner end position I (FIG. 20*b*) and second, due to its traversability, it can also allow the bearing journal 12 to travel even further into the roll 10 or into the axial support located therein, as shown by FIG. 20*c*. This is then the transportation position T, in which tightly packed storage of refills, for example in an outer box, is possible. However, despite this possibility of being pushed into the transportation position T, an inner end position is still set in a defined manner—as shown in FIG. 20*b*.

In many embodiment examples shown, in particular in those according to FIGS. 13*a* to 20*c*, the bearing journal 12 is mounted in a displaceable manner on (FIG. 17*a*, FIG. 17*b*) or in (the other aforesaid figures) the axial support and preferably has a smaller diameter than the axial support. As a result, the axial support can be held in the wound material web clamped radially outwards, while the bearing journal 12 can be moved axially further radially inwards.

It is also possible for the axial support and the axially displaceable bearing journal to lie substantially one behind the other—when viewed in the axial direction—as is the case, for example, in FIGS. 25, 26, 27 and 30, yet to be described in more detail.

It is clear from the previously described embodiment examples that the bearing journal 12 advantageously has a—preferably cylindrical—neck 12*c* and a head 12*b* having a larger diameter than the neck 12*c*.

By means of this construction, a mechanical testing device, for example in the form of a curved mechanical track, as shown by FIGS. 5 to 8, can move the bearing journal in the axial direction, namely can pull it out of the refill, i.e. move it from the inner to the outer end position, but also act on it in the opposite direction. Pulling out is possible due to engagement behind the head 12*b* in the region of the neck 12*c*.

A good mounting and possibility of movement of the bearing journal in a guide track are possible if the end face of the bearing journal is formed by the top surface of the head 12*b* running substantially perpendicular to the longitudinal axis.

For the basic functioning of the invention, all that is necessary is for one of the two bearing journals to be formed according to the invention in an axially displaceable manner. However, embodiment examples in which both bearing journals are axially displaceable are also conceivable and possible. This is the case in the embodiment example represented in FIG. 10, for example. Here, the left-hand bearing journal 13 and the right-hand bearing journal 13 are axially displaceable with respect to the axial support designed as a support bar 11. There, the left-hand bearing journal 13 is acted on by a spring 17 or in general by an energy storage mechanism. Instead of mechanical springs 17, rubber-elastic units (FIG. 26), magnets (FIG. 27) or fluid-filled piston-cylinder units (FIG. 28) also come into consideration as energy storage mechanisms.

These figures will be described in more detail below.

Figure 21A:
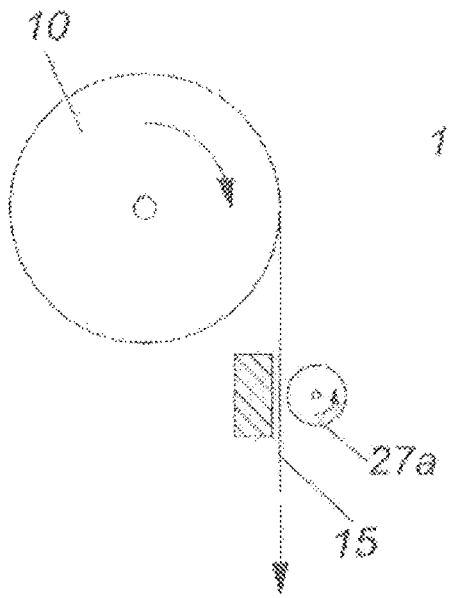
FIG. 21*a* is a side view of a schematic detail of an embodiment example of a dispenser.
Figure 21B:
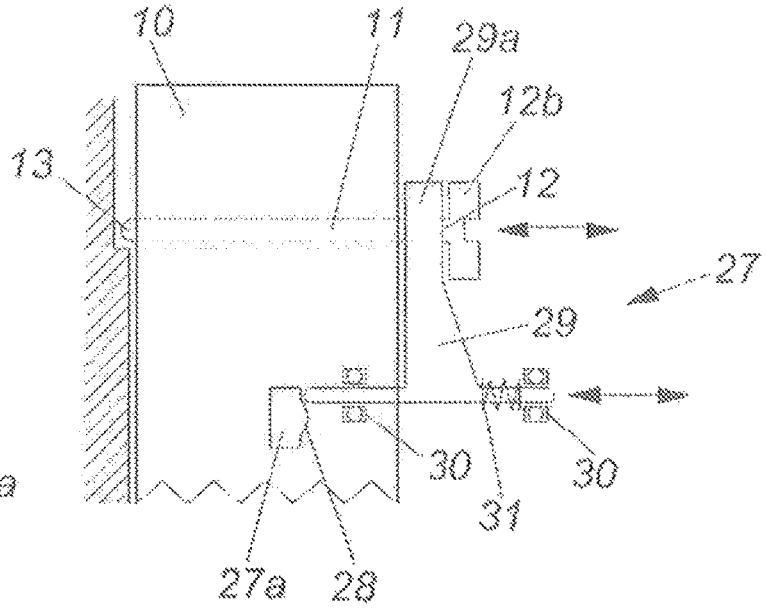
FIG. 21*b* is a front view of the detail.
Figure 21C:
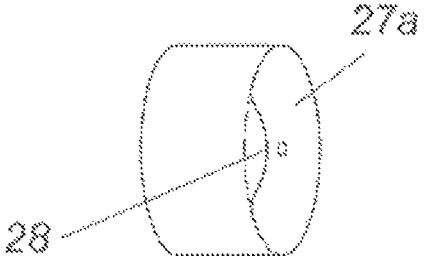
FIG. 21*c* is a perspective view of the corresponding detail.

The invention relates not only to a refill and to a bearing unit for such a refill, but also to a dispenser. This has already been explained at the outset with reference to FIGS. 1 to 12. A variant of the invention provides a dispenser for portions of a refill with a material web wound to form a roll, wherein the refill has at least one bearing journal, which can be guided in a guide track of the dispenser from an insertion position into a dispensing position, wherein the refill is rotatably mounted when in the dispensing position. The dispenser has a testing device for verifying the axial displaceability of the bearing journal with respect to the roll of the refill, wherein the dispensing of portions of the material web is released or blocked depending on the axial displaceability of the bearing journal. In the dispensers represented in FIGS. 1 to 12, the testing device according to the invention is mechanically implemented substantially by an axially offset (curved) portion of the guide track. In this portion, the testing device attempts to move the bearing journal 12 axially and to then release or block the dispensing of the material web 15 depending on the axial displaceability. This releasing or blocking or making inoperative can occur as the material web wound to form a roll (refill), which is inserted into the dispenser from above, travels downwards into the actual dispensing position, with the result that the testing occurs before the dispensing position, in which the roll then rotates to dispense the paper, is reached. However, it is also possible for the testing to be carried out in the dispensing position, as represented schematically by FIGS. 21*a* and 21*b* by way of example. Here, a "normal" support bar 11 (axial support), i.e. one not formed according to the invention, is provided. This has a bearing journal 12 which is not axially displaceable with respect to the support bar 11, but rather is rigidly secured thereto. It has a head 12*b*. In the dispensing position in FIGS. 21*a* and 21*b*, when the material web 15 is pulled downwards and the roll 10 thus rotates clockwise (21*a*), the testing device, denoted by 27 as a whole, now constantly attempts to move the axial journal axially. For this purpose, the testing device includes a friction roller 27*a*, which abuts the material web 15 and is set in rotation by this in the case of pulling. As shown in FIG. 21*c*, this friction roller 27*a* has a curved hump 28 on its end face. This curved hump collides with the testing lever 29, which, as shown in FIG. 21*b*, is mounted displaceably in bearings 30 and is acted on to the left by a spring 31. If the hump 28 collides with the testing lever 29 during rotation, it pushes this to the right. The fork-shaped end 29*a*, which surrounds the bearing journal 12, then pulls the latter to the right by engaging behind the head 12*b*. If a "normal" support bar 11 or axial support is now used, when it is pulled to the right, the left-hand bearing journal 13 falls out of a hold of the dispensing position and the entire roll 10 or refill is then no longer correctly mounted and dispensing is prevented. If, however, the right-hand bearing journal 12 can be axially displaced with respect to the inserted support bar 11, as provided according to the invention, the bearing journal 12 can oscillate during the pulling movement, without the support bar 11 and the left-hand bearing journal 13 which is connected thereto in one piece, falling from their mounting. Such a refill or such a bearing unit with an axially displaceable right-hand bearing journal then passes the axial test.

Figure 22:
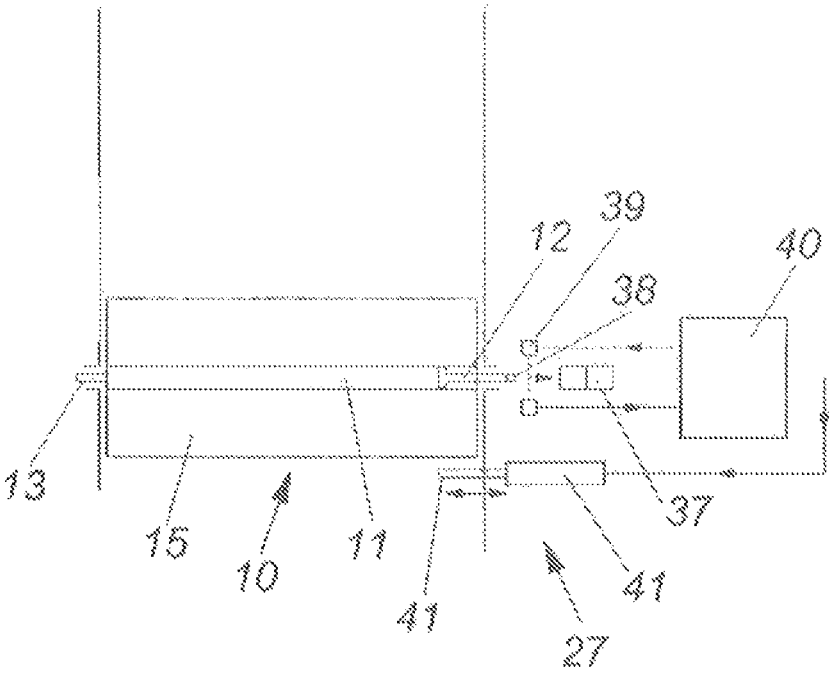
FIG. 22 is a schematic front view of an embodiment example of a part of a dispenser according to the invention.

FIG. 22 shows a testing device 27 for a roll 10 located in the dispensing position, with a material web 15 wound around a support bar 11. The right-hand bearing journal 12 is formed axially displaceable. The testing device contains a testing magnet 37, which interacts with a testing magnet 38 on the outer end of the axially displaceable bearing journal 12. The testing magnet 37 attempts to move the bearing journal 12 to the right in FIG. 22. If this is successful due to its axial displaceability, it enters the photoelectric sensor 39 and the electronic evaluator releases the catch 41, represented schematically, with the result that the material web can be dispensed. If the bearing journal 12 is not axially displaceable, the photoelectric sensor 37 does not respond and the evaluator 40 blocks dispensing by means of the catch 41. Here, therefore, the axial displaceability can be electromechanically verified as a whole in the dispensing position with the testing device 27.

Figure 23:
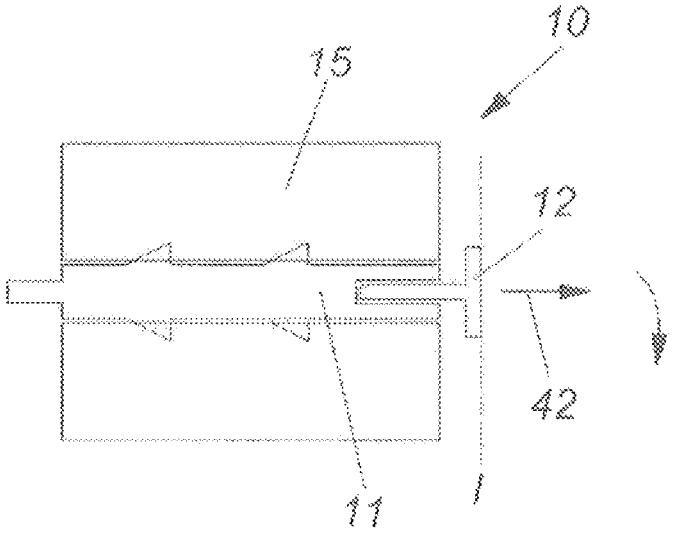
FIG. 23 is an illustration of an embodiment example of the refill according to the invention with an axially adjustable bearing journal, a defined inner end position, but without an outer defined end position.

FIG. 23 shows an embodiment example of a refill or roll 10 according to the invention with an axial support designed in the form of a support bar 11, in which the right-hand bearing journal 12 is axially displaceable while the left-hand bearing journal 13 is formed in one piece with the support bar 11. In this embodiment, there is a defined inner end position I, in which the bearing journal 12 still protrudes beyond the refill. This is defined in that the bearing journal, formed having a T-shaped cross section, abuts the inner end at the bottom of a blind hole in the support bar 11.

Starting from this inner end position, the bearing journal 12 can then be pulled outwards, wherein in principle no defined outer end position must be provided to implement the proper functioning of the invention. In the embodiment example represented in FIG. 23, the bearing journal 12 is namely loosely inserted, and can be completely separated from the support bar 11 when it is pulled out to the right in the direction of the two arrows. Of course, measures can be taken to prevent the bearing journal 12 from falling out of the support bar 11 during transportation.

Figure 24:
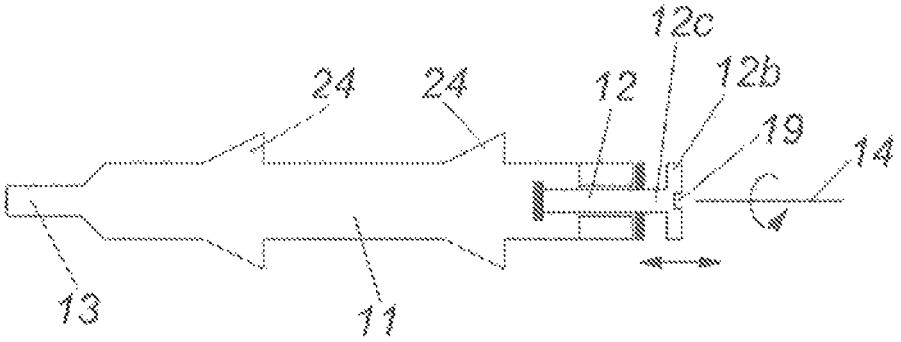
FIG. 24 is an illustration of a particularly preferred embodiment of a bearing unit according to the invention with a bearing journal adjustable axially between a defined inner end position and a defined outer end position.

The embodiment example represented in FIG. 24 is a particularly preferred embodiment with an axial support or support bar 11 which has laterally projecting protrusions 24, which provide a good retention in a material web wound to form a roll. The left-hand bearing journal is formed as one piece with the support bar 11 whilst the right-hand bearing journal 12 is axially displaceable according to the invention, namely by the displacement amount v, wherein the inner and outer end positions are defined and set by stops and counter-stops, not described in more detail here. The right-hand bearing journal 12 is also rotatable in the axis of rotation or roll axis 14 and on the end face has a groove 19 or generally a non-rotational surface. With such a bearing journal, a rotary coding and an axial coding can be achieved.

In the embodiment example represented in FIG. 25, the right-hand bearing journal 12 is arranged in a line with the actual support bar 11 or axial support together with the left-hand bearing journal 13, thus one behind the other when viewed in the axial direction. In between, an energy storage mechanism in the form of a compression spring 17 acts.

The inner end position, which is shown in FIG. 25, is defined by the inner end of the bearing journal 12 abutting the right-hand end of the support bar 11. Similarly to the embodiment example according to FIG. 23, there is no outer defined end position here.

Figure 26:
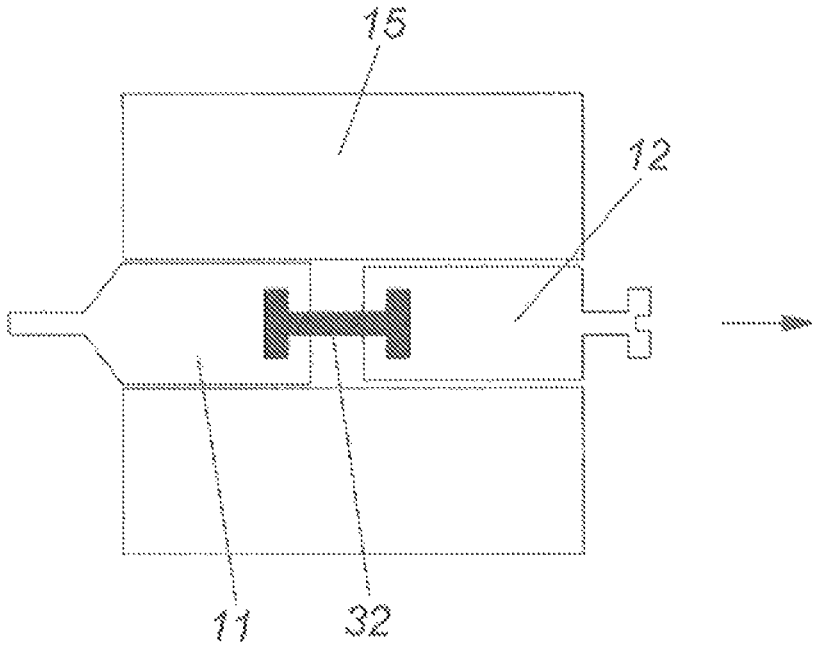
FIGS. 26 and 27 are illustrations showing in each case further embodiment examples in an axial longitudinal section.

FIG. 26 is formed similarly. Here, however, the energy storage mechanism consists substantially of a rubber-elastic unit 32 which is fully compressed in FIG. 26 and thus sets the inner end position. Starting from this inner end position, the bearing journal 12 can be moved outwards to the right in the direction of the arrow, wherein the rubber-elastic unit 32 is stretched.

Figure 27:
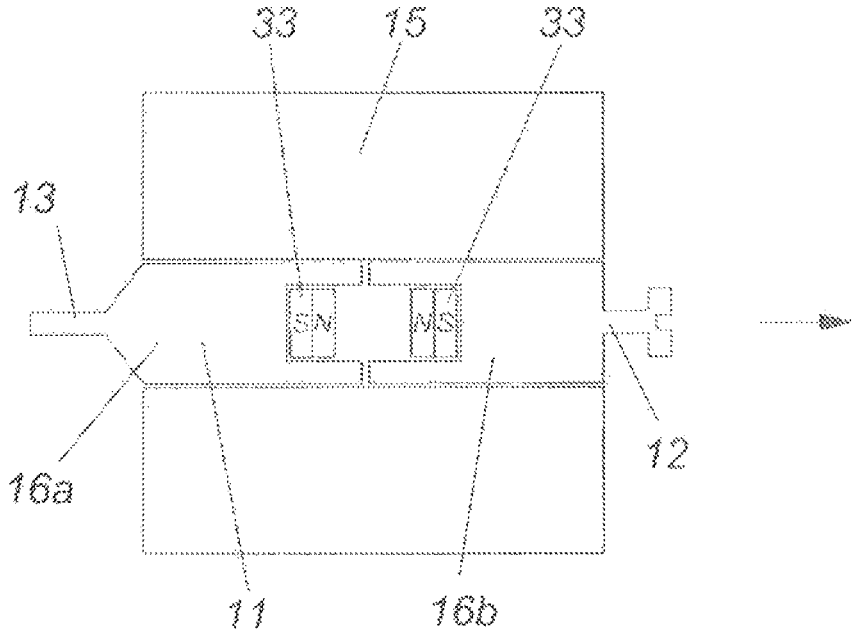

In the embodiment example represented in FIG. 27, the right-hand bearing journal 12 is axially displaceable with respect to the axial support or support bar 11 and in part itself also functions as an axial support. The two parts 16*a* and 16*b* are arranged one behind the other in the axial direction. Between the two parts magnets act in the repelling direction and thus form an energy storage mechanism which attempts to push the two parts 16*a* and 16*b* apart.

Figure 28:
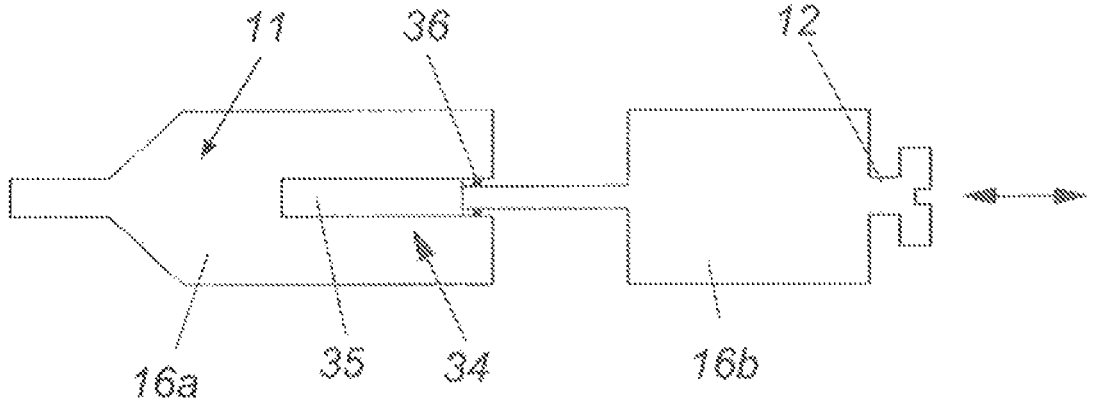
FIGS. 28 to 30 are illustration showing in each case embodiment examples of bearing journals according to the invention in an axial longitudinal section.

A similar function is implemented in the embodiment according to FIG. 28. Here, a piston-cylinder unit 34 acts as an energy storage mechanism between the two parts 16*a* and 16*b*, wherein the cylinder is filled with a gaseous compressible fluid 35. A seal is denoted by 36. Here too, the piston-cylinder unit 34 acts as an energy storage mechanism which pushes the two parts 16*a* and 16*b* apart. In all the embodiment examples according to FIGS. 25 to 28, any testing device present needs to exert a force axially inwards only in one direction. The energy storage mechanism, which is implemented in many different forms (springs 17, rubber-elastic units 32, magnets 33 or piston-cylinder units 34) then acts in the other direction.

FIG. 29 shows a one-piece embodiment in which the spring 17 is formed in one piece with the support bar 11 or the right-hand bearing journal 12.

Figure 30:
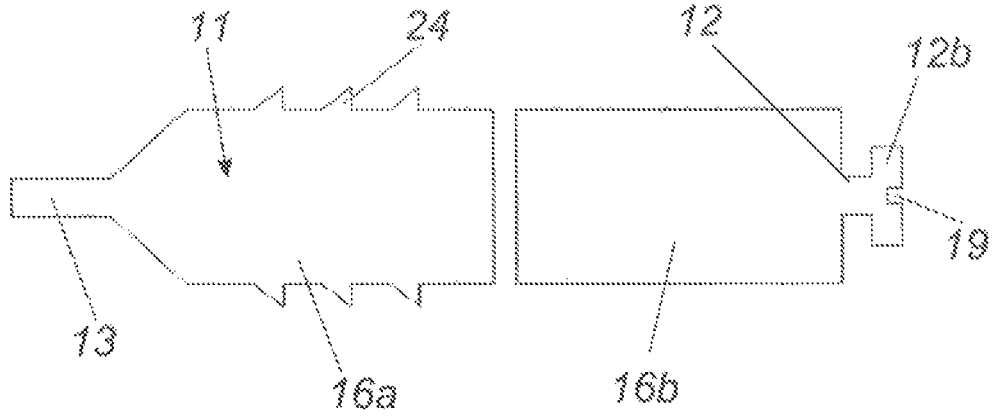

FIG. 30 schematically shows a simple embodiment example of a bearing unit according to the invention with two components 16*a* and 16*b* arranged one behind the other in the axial direction, wherein the left-hand component has protrusions 24 and acts as an axial support in a refill. The right-hand part 16*b* is simultaneously an axial support and, at its right-hand end, a bearing journal 12. The inner defined end position is reached by the two parts 11 and 12 abutting one another. For reasons of clarity, FIG. 30 still shows a small gap between the two parts, but this disappears when the inner end position is reached.

Figure 31:
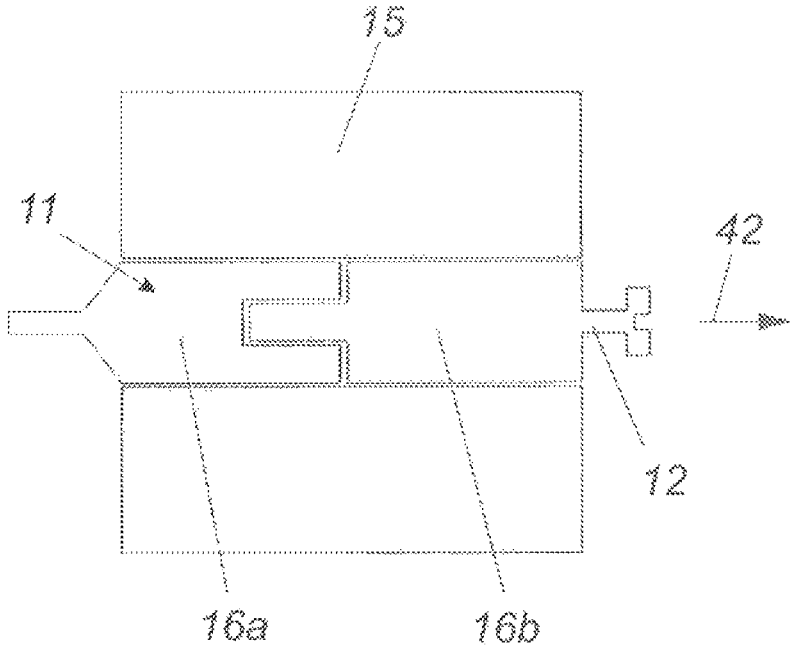
FIG. 31 is an illustration showing an embodiment example of the refill according to the invention in an axial longitudinal section.

In the embodiment of a refill according to the invention according to FIG. 31, two parts 16*a* and 16*b* lying one behind the other when viewed in the axial direction are likewise provided, but these are additionally interconnected in an axial tongue-and-groove connection to increase stability.

Figure 32:
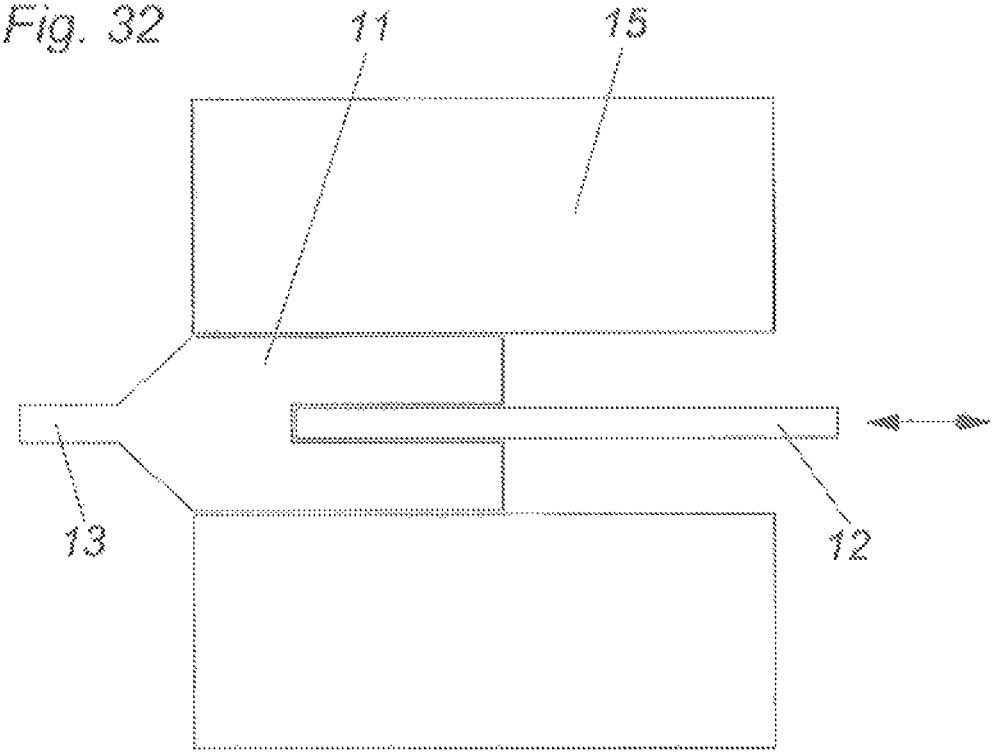
FIG. 32 is an illustration showing a further embodiment example of the refill according to the invention in an axial longitudinal section.

In the embodiment example represented in FIG. 32 of a refill according to the invention, the bearing journal 12, which is mounted axially displaceable in the support bar 11 or axial support, does not have a separate head. Here, the testing device must be designed differently from FIGS. 1 to 11. For example, the testing device can attempt to move the bearing journal 12 axially by means of frictional locking. Depending on the test result, a release or blocking of dispensing in the sense of an axial coding can then be effected by means of a suitable mechanical or electronic control. FIG. 32 shows that, although the head 12*b* able to be engaged from behind is preferred, it is in principle not required for the functionality.

Figure 33:
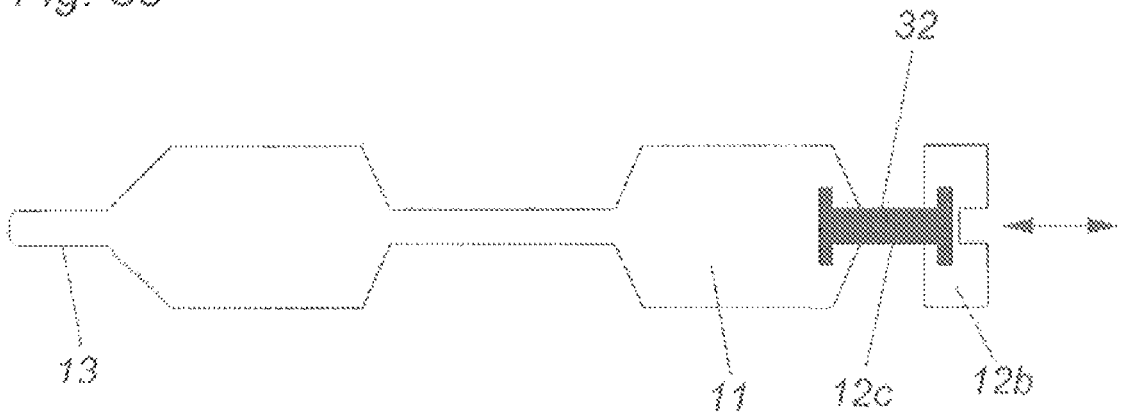
FIGS. 33 and 34 are illustrations showing in each case embodiment examples of bearing journals according to the invention in an axial longitudinal section.
Figure 34:
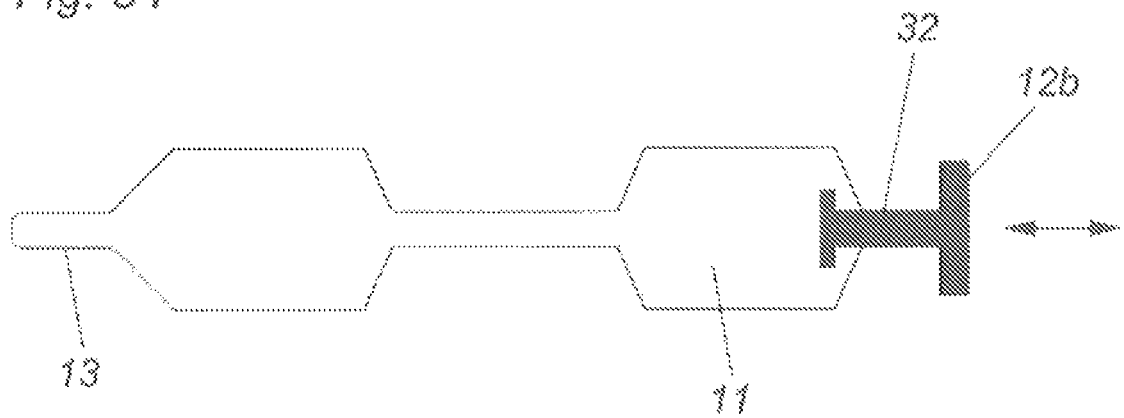

In the embodiment examples shown in FIGS. 33 and 34, a rubber-elastic element is used again to produce the axial displaceability of the bearing journal 12, more precisely of its head 12*b*. In the embodiment example represented in FIG. 33, the head 12*b* is formed of a relatively hard material and only the neck 12*c* is formed of rubber-elastic material (including the T-shaped anchoring protruding on both sides in the parts 11 and 12*b*). In the embodiment example represented in FIG. 34, the head 12*b* itself is also made of rubber-elastic material.

LIST OF REFERENCE NUMBERS

1 dispenser
2 cover
3 walls
4 guide track
5 axially offset portion
6 insertion position
7 dispensing position
8 collection chamber
9 cardboard core
10 roll/refill
11 support bar
11*a* counter-stop
11*b* traversable inner counter-stop
11*c* limit stops
12 bearing journal
12*a* stop
12*b* head able to be engaged from behind
12*c* neck
13 bearing journal
14 roll axis
15 material web
16*a,b* axially displaceable parts of the support bar
17 spring
18 end cap
19 (radial) groove
20 ridge
21 ridges
22 collar
23 claw
24 protrusions
25 unwinding arrow
26 small arrow
27 testing device
27*a* friction roller
28 hump
29 testing lever
29*a* (fork-shaped) end
30 bearing

31 spring
32 rubber-elastic unit
33 magnets
34 piston-cylinder unit
35 fluid
36 seal
37 testing magnet
38 magnet
39 photoelectric sensor
40 evaluator
41 catch
42 arrow
43 retaining tip

The invention claimed is:

1. A refill for a dispenser, the refill comprising:
a material web wound to form a roll;
a bearing unit having an axial support disposed in said material web wound to form said roll;
at least one bearing journal mounted so as to be axially displaceable with respect to said axial support, wherein said at least one bearing journal is mounted so as to be rotatable about its longitudinal axis with respect to said axial support and wherein said at least one bearing journal has a shape without circular symmetry with respect to the longitudinal axis of said at least one bearing journal at least in areas;
said at least one bearing journal being mounted so as to be displaceable between a defined inner end position and a defined outer end position and to protrude axially beyond said roll when in both the inner and outer end positions; and
stops that define the defined inner and outer end positions of said at least one bearing journal.

2. The refill according to claim 1, further comprising:
a further axial support; and
at least one further bearing journal mounted on an opposite side with respect to said at least one bearing journal, wherein said at least one further bearing journal is rigidly connected to said axial support or said further axial support or is formed on thereon.

3. The refill according to claim 1, wherein:
said at least one bearing journal is one of two bearing journals; and
said axial support is a support bar extending through said roll and has one of said bearing journals on each side of said axial support, at least one of said bearing journals is mounted so as to be axially displaceable relative to said support bar.

4. The refill according to claim 1, wherein:
said axial support is one of two separate axial supports for said roll and are formed as end caps, and are inserted into said roll at each opposite end; and
said at least one bearing journal is mounted axially displaceable on at least one of said end caps.

5. The refill according to claim 4, wherein said end caps are cylindrical end caps.

6. The refill according to claim 1, wherein:
said axial support is one of two separate axial supports which are formed as retaining tips and are axially disposed in said roll and at opposite ends of said roll; and
said at least one bearing journal is mounted axially displaceable on at least one of said retaining tips.

7. The refill according to claim 6, wherein said roller is wound in a coreless manner.

8. The refill according to claim 1, wherein said axial support is non-rotatably held in said roll.

9. The refill according to claim 8, further comprising radially projecting protrusions, said axial support is non-rotatably held in said roll by said radially projecting protrusions.

10. The refill according to claim 1, wherein said material web is wound to form a coreless roll.

11. The refill according to claim 1, further comprising a cylindrical core and said material web is wound around said cylindrical core.

12. The refill according to claim 11, wherein said cylindrical core is made of cardboard.

13. The refill according to claim 1, wherein said material web is toilet paper.

14. The refill according to claim 13, wherein said toilet paper has tear-off perforations.

15. The refill according to claim 1, wherein said material web is paper towels.

16. A bearing unit for a refill formed from a material web wound to form a roll, the bearing unit comprising:
an axial support for inserting into the material web;
at least one bearing journal mounted so as to be axially displaceable with respect to said axial support, wherein said at least one bearing journal is mounted so as to be rotatable about its longitudinal axis with respect to said axial support and wherein said at least one bearing journal has a shape without circular symmetry with respect to the longitudinal axis of said at least one bearing journal at least in areas;
said axial support having a counter stop; and
at least one stop attached to or formed on said at least one bearing journal, said at least one stop strikes said counter-stop on said axial support, whereby an inner and outer end position of said at least one bearing journal are defined.

17. The bearing unit according to claim 16, wherein said bearing journal has a smaller diameter than said axial support.

18. The bearing unit according to claim 16, wherein said axial support and said at least one bearing journal lie substantially one behind another, when viewed in an axial direction.

19. The bearing unit according to claim 16, wherein said at least one bearing journal has a non-rotationally symmetrical shape on its end face.

20. The bearing unit according to claim 19, wherein said non-rotationally symmetrical shape is a groove running transverse to the longitudinal axis formed on said end face.

21. The bearing unit according to claim 16, wherein said at least one bearing journal has a neck and a head having a larger diameter than said neck on an end side.

22. The bearing unit according to claim 21, wherein an end face of said at least one bearing journal is formed by a top surface of said head, running substantially perpendicular to the longitudinal axis.

23. The bearing unit according to claim 21, wherein said neck is a cylindrical neck.

24. The bearing unit according to claim 16, further comprising at least one further bearing journal mounted on an opposite side of said axial support with respect to said at least one bearing journal.

25. The bearing unit according to claim 16, further comprising an energy storage mechanism, said at least one bearing journal is acted on by said energy storage mechanism.

26. The bearing unit according to claim 25, wherein said energy storage mechanism has a spring, a rubber-elastic unit, a magnet and/or a fluid-filled piston-cylinder unit.

27. The bearing unit according to claim 16, wherein said counter-stop defining the inner end position is traversable, with a result that said at least one bearing journal can be moved beyond said counter-stop into a fully inner transportation position.

28. The bearing unit according to claim 16, wherein said at least one bearing journal is one of at least two bearing journals, at least one of said at least two bearing journals has an end able to be engaged from behind.

29. The bearing unit according to claim 28, further comprising a flange provided on said end of said at least one bearing journal able to be engaged from behind.

30. The bearing unit according to claim 28, wherein said at least one bearing journal able to be engaged from behind has non-rotational surfaces with respect to a roll axis disposed on said end of said at least one bearing journal able to be engaged from behind.

31. The bearing unit according to claim 30, wherein:

said end of said at least one bearing journal able to be engaged from behind has an end face with a diametric groove formed therein; and said non-rotational surfaces are disposed on said end of said at least one bearing journal able to be engaged from behind, via said diametric groove in said end face.

32. The bearing unit according to claim 28, wherein said end has a head.

33. The bearing unit according to claim 16, wherein at least part of said at least one bearing journal is formed from a rubber-elastic material.

34. A refill, comprising:

a material web wound to form a roll; and said bearing unit according to claim 16, said bearing unit disposed in said roll.

35. A device, comprising:

a refill for a dispenser, said refill containing a material web wound to form a roll;

a bearing unit having an axial support disposed in said material web wound to form said roll and at least one bearing journal mounted so as to be axially displaceable with respect to said axial support, wherein said at least one bearing journal is mounted so as to be rotatable about its longitudinal axis with respect to said axial support and wherein said at least one bearing journal has a shape without circular symmetry with respect to the the longitudinal axis of the at least one bearing journal at least in areas, wherein when said at least one bearing journal is in a transportation position said at least one bearing journal lies inside said roll and does not protrude at sides of said roll;

said axial support having a counter stop; and at least one stop attached to or formed on said at least one bearing journal, said at least one stop strikes said counter-stop on said axial support, whereby an inner and outer end position of said at least one bearing journal are defined.

* * * * *